US007506486B2

(12) United States Patent
Wegner et al.

(10) Patent No.: US 7,506,486 B2
(45) Date of Patent: Mar. 24, 2009

(54) MODULAR PACKAGING SYSTEM

(75) Inventors: Thomas S. Wegner, Cecil, WI (US); Peter T. Hunnicutt, Greenville, WI (US); Douglas P. Wegner, Shawano, WI (US); Jeffrey D. Cogswell, Appleton, WI (US); Scott A. Santaga, Green Bay, WI (US); Michael A. Yuenger, Green Bay, WI (US)

(73) Assignee: Infinity Machine & Engineering Corp., Green Bay, WI (US)

( * ) Notice: Subject to any disclaimer, the term of this patent is extended or adjusted under 35 U.S.C. 154(b) by 0 days.

(21) Appl. No.: 11/493,987

(22) Filed: Jul. 27, 2006

(65) Prior Publication Data

US 2007/0022715 A1 Feb. 1, 2007

Related U.S. Application Data

(60) Provisional application No. 60/705,971, filed on Aug. 5, 2005, provisional application No. 60/704,002, filed on Jul. 29, 2005.

(51) Int. Cl.
*B65B 59/04* (2006.01)

(52) U.S. Cl. ..... 53/167; 53/201; 198/413; 414/798.5

(58) Field of Classification Search ..... 53/167, 53/201, 247, 249, 252, 255, 258, 566; 198/412, 198/413; 414/798.5; *B65B 59/00, 59/04*
See application file for complete search history.

(56) References Cited

U.S. PATENT DOCUMENTS 2,043,411 A * 6/1936 Kimball ..... 53/505
2,613,021 A * 10/1952 Bowes ..... 53/496
2,642,212 A * 6/1953 Currivan ..... 53/252
2,650,009 A * 8/1953 Kerr ..... 53/537
2,956,381 A * 10/1960 Chauvin et al. ..... 53/446
3,284,985 A * 11/1966 Roth ..... 53/247
3,295,294 A * 1/1967 Galloway ..... 53/252
3,343,335 A * 9/1967 Pearson ..... 53/564
3,388,527 A * 6/1968 Vadas ..... 53/247
3,410,049 A * 11/1968 Steenberg et al. ..... 53/153
3,410,052 A * 11/1968 Johnson et al. ..... 53/249
3,526,075 A * 9/1970 Zurhoefer et al. ..... 53/447
3,546,838 A * 12/1970 Alduk ..... 53/77
3,729,085 A * 4/1973 Schlueter et al. ..... 198/418.1

(Continued)

FOREIGN PATENT DOCUMENTS

DE 20313807 U1 * 12/2003

(Continued)

*Primary Examiner*—Stephen F Gerrity
(74) *Attorney, Agent, or Firm*—Foley & Lardner LLP

(57) ABSTRACT

A modular packaging system includes a base system configured to manipulate a product and configured to receive at least one of a group of packaging modules, wherein the base system is used with a variety of packaging modules depending on a desired packaged output. The system also includes a first packaging module selectively coupled to the base system, the packaging module having a first member coupled to the packaging module, the member configured to manipulate an object. The system may also include a second packaging module selectively coupled to the base system, the second packaging module having a lifting device coupled to the second packaging module, the lifting device configured to manipulate an object.

10 Claims, 19 Drawing Sheets

U.S. PATENT DOCUMENTS 3,735,561 A * 5/1973 Wood ..... 53/245
3,832,101 A 8/1974 Rainville
3,852,936 A * 12/1974 Wilson et al. ..... 53/443
4,077,441 A 3/1978 Rosen et al.
4,081,945 A 4/1978 Calvert et al.
4,263,766 A * 4/1981 Baker et al. ..... 53/50
4,329,831 A * 5/1982 Warkentin et al. ..... 53/537
4,371,075 A 2/1983 Erlichman
4,492,297 A 1/1985 Sticht
4,534,153 A * 8/1985 Nowicki ..... 53/448
4,565,048 A 1/1986 Lade
4,566,251 A * 1/1986 Spisak et al. ..... 53/167
4,583,351 A * 4/1986 Fallas ..... 53/501
4,679,379 A 7/1987 Cassoli
4,750,317 A * 6/1988 Vrana ..... 53/541
4,760,683 A * 8/1988 Hirschberger et al. ..... 53/170
4,762,218 A 8/1988 Sticht
4,776,146 A * 10/1988 Whitehouse ..... 53/58
4,823,929 A 4/1989 Fleming et al.
4,971,189 A 11/1990 Fleming et al.
5,056,294 A 10/1991 Focke
5,060,451 A 10/1991 DeMay et al.
5,165,218 A * 11/1992 Callahan, Jr. ..... 53/447
5,228,273 A 7/1993 Kovacs
5,377,478 A 1/1995 Kovacs et al.
5,433,063 A 7/1995 Kovacs et al.
5,447,012 A 9/1995 Kovacs et al.
5,528,883 A 6/1996 Jamison
5,539,975 A 7/1996 Kukuljan et al.
5,595,043 A * 1/1997 Radigan ..... 53/201
5,685,130 A * 11/1997 Horsman ..... 53/510
5,778,640 A * 7/1998 Prakken et al. ..... 53/475
5,852,912 A 12/1998 Chalendar
5,884,746 A 3/1999 Leisner et al.
5,904,242 A 5/1999 Swanson
5,913,795 A * 6/1999 Schubert ..... 53/201
6,019,046 A 2/2000 Rodi
6,484,475 B1 * 11/2002 Neagle et al. ..... 53/167
6,535,786 B1 3/2003 Duemler
6,854,242 B2 * 2/2005 Stork et al. ..... 53/53
6,907,711 B2 * 6/2005 Ishii et al. ..... 53/54
2004/0098948 A1 * 5/2004 Caporali et al. ..... 53/443
2005/0247026 A1 * 11/2005 Griggs et al. ..... 53/131.4
2006/0090419 A1 * 5/2006 Chrisman et al. ..... 53/64

FOREIGN PATENT DOCUMENTS

EP 1512632 B1 * 3/2007

* cited by examiner

MODULAR PACKAGING SYSTEM

CROSS-REFERENCE TO RELATED PATENT APPLICATIONS

This application claims the benefit of priority under 35 U.S.C. § 119(e) to U.S. Patent Application No. 60/704,002, filed Jul. 29, 2005, titled "Modular Packing System" and U.S. Patent Application No. 60/705,971, filed Aug. 5, 2005, titled "Case-Packaging System" which are both incorporated by reference in their entirety.

FIELD

The present invention relates to a modular packaging system. The present invention more specifically relates to a modular packaging system for packaging, bundling, bagging and/or wrapping an object or group of objects such as tissue or paper products.

BACKGROUND

Packaging systems for packaging, bundling, bagging or wrapping a product are generally known; however, such packaging systems do not realize certain advantageous features (and/or combinations of features).

For example, production lines for products such as tissue or paper products (e.g. toilet tissue, napkins, paper towels, etc.) are often used to produce many different labeled products. Traditionally, the product is packaged into cardboard cases to provide "case-packed" products for ease of handling and shipping. A more recent method packages a group of products in a film "overwrap" often referred to as a "bundle". The bundles can be handled similarly to the case-packed products. The method of packaging products into a bundle is generally less expensive than the method of producing case-packed products due to a lower cost of the film packaging material. Bagging and wrapping are other available packaging methods. Wholesalers and distributors of the products may prefer a variety of packaging forms for the products (e.g. case-packed, bundled, bagged, wrapped, etc.), thus creating a need to be able to handle a variety of products using different packaging methods on a single production line.

A typical production line for the above mentioned methods of packaging usually includes an infeed conveyor (e.g. used to carry product to the machine) and a lane diverter (e.g. used to either combine multiple infeed lanes of product to less lanes or to expand from fewer to more lanes depending on the configuration of the production line and the product grouping being produced). Typical packaging methods on such a production line may include 1.) case-packing where diverted lanes of product are collated into the proper configuration for the case, the case is erected from its collapsed state, and the collated products are loaded into the case; 2.) bundling, where diverted lanes of product are oriented and grouped into bundle sized configurations then wrapped and sealed into the overwrap material; 3.) bagging, where diverted lanes of product are oriented and loaded into a bag; and 4.) wrapping, where diverted lanes of product are oriented and wrapped with either a paper or poly overwrap material.

Each packaging method typically includes independent infeed conveying and lane diverting equipment along with a manual conveyor switching device to switch between each packaging method.

Conventional production facilities will have at least one of these packaging methods; more frequently production facilities will have two, three or all four packaging methods. Production facilities with only one packaging method often lack floor space and/or capital for the required equipment of additional packaging methods, thus significantly limiting their marketing abilities. Thus, a need exists for a modular packaging system or the like of a type disclosed in the present application that includes any one or more of these or other advantageous features.

1. A modular packaging system that is simple to use, construct, and manufacture.
2. A modular packaging system that provides for a variety of packaging methods.
3. A modular packaging system that provides for a variety of differently sized packaged products.
4. A modular packaging system that is capable of making efficient use of space through interchangeable packaging modules.
5. A modular packaging system that is capable of manipulating products in a small area.
6. A modular packaging system that is capable of upending products in a small area without tipping them over.
7. A modular packaging system that can be easily repositioned.
8. A modular packaging system that can be easily transformed from one packaging method to a second packaging method.
9. A modular packaging system that is easily coordinated with conventional production line equipment.
10. A modular packaging system that provides convenient and simple access for maintenance.
11. A modular packaging system that may be easily and conveniently adjusted for improved overall efficiency.

SUMMARY

The present invention relates to a modular packaging system that includes a base system configured to manipulate a product. The system also includes a packaging module selectively chosen to be used with the base system, the packaging module having a member coupled to the packaging module, the member configured to manipulate an object.

The present invention also relates to a modular packaging system that includes a base system configured to manipulate a product. The system also includes a packaging module selectively chosen to be used with the base system, the packaging module having a lifting device coupled to the packaging module, the lifting device configured to manipulate an object.

The present invention also relates to a base system configured to manipulate a product and configured to receive at least one of a group of packaging modules, wherein the base system is used with a variety of packaging modules depending on a desired packaged output. The base system includes multiple connectors configured to receive a packaging module. The base system also includes a diverter configured to expand or decrease incoming lanes of product. The base system further includes a flight bar conveyor system configured to move a product from the diverter to the packaging module.

The present invention also relates to a method for providing a packaging system including the step of providing a base system configured to manipulate products to be packaged. The method also includes the step of providing a first packaging module configured to package products into a case. The method further includes the step of providing a second packaging module configured to package products into a bundle. The method further includes the step of selecting either a first or second packaging module depending on the desired type of packaging output.

The present invention also relates to a modular packaging system for packaging an article including a base system configured to manipulate a product and configured to receive at least one of a group of packaging modules, the base system comprising multiple connectors configured to receive a packaging module; a diverter configured to expand or decrease incoming lanes of product; and a flight bar conveyor system configured to move a product from the diverter to the packaging module, wherein the base system is used with a variety of packaging modules depending on a desired packaged output. The system also includes a first packaging module selectively coupled to the base system, the packaging module having a first member coupled to the packaging module, the member configured to manipulate a case. The system further includes a second packaging module selectively coupled to the base system, the second packaging module having multiple fingers radially coupled to the second packaging module, the multiple fingers configured to manipulate an object from a horizontal orientation to a vertical orientation.

DETAILED DESCRIPTION

Figure 1:
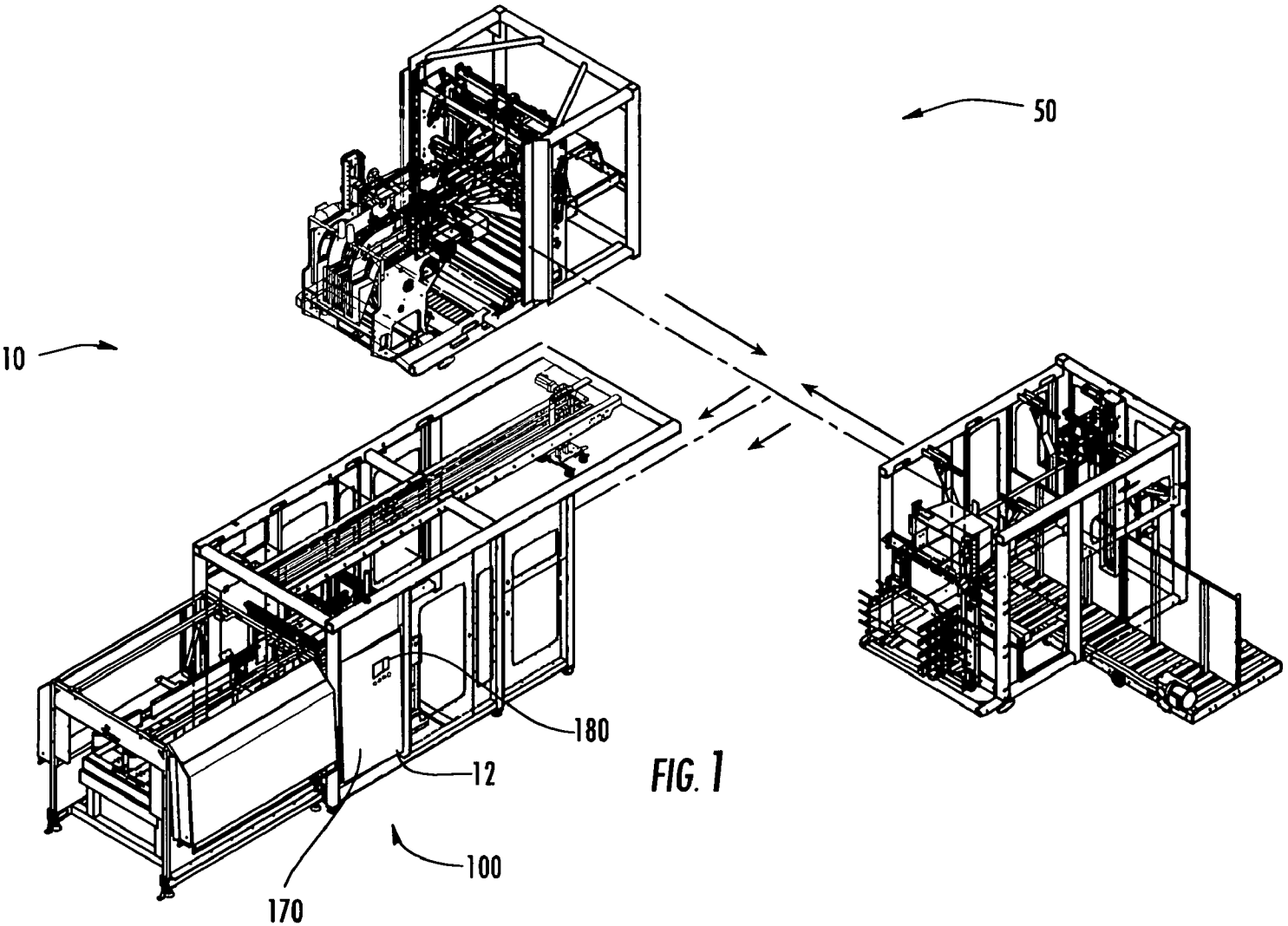
FIG. 1 is a front perspective view of a modular packaging system according to an exemplary embodiment.

Referring to FIG. 1, a modular packaging system 10 is shown to include a base system 100 and interchangeable packaging modules 50 according to an exemplary embodiment. The base system 100 is configured to receive an interchangeable packaging module 50. The base system 100 may contain the common components to each interchangeable packaging module (i.e. an infeed conveyor, a lane diverter, motor drives, logic controller), thereby eliminating (or minimizing) redundant components. A modular packaging system 10 has a reduced "footprint" intended to more efficiently use floor space in a facility. Additionally, the interchangeable packaging modules maybe remotely storable (e.g. stored offline, stored onsite, stored offsite) when not in use to save additional floor space. Interchangeable packaging modules are shown here to include a case-packing module 200 and a bundling module 300. Other interchangeable packaging modules may include a bagging module, a poly-wrapping module and a paper wrapping module.

As shown in FIG. 1, both the base system 100 and interchangeable packaging modules have safety guards and panels 12. Guards and panels 12 may be constructed from one or more of a variety of different materials, including, for example, sheet metal, polycarbonate or acrylic, and may be configured in any shape and size. In the remaining figures, the guards and panels 12 have been removed for clarity.

Base System

Figure 2:
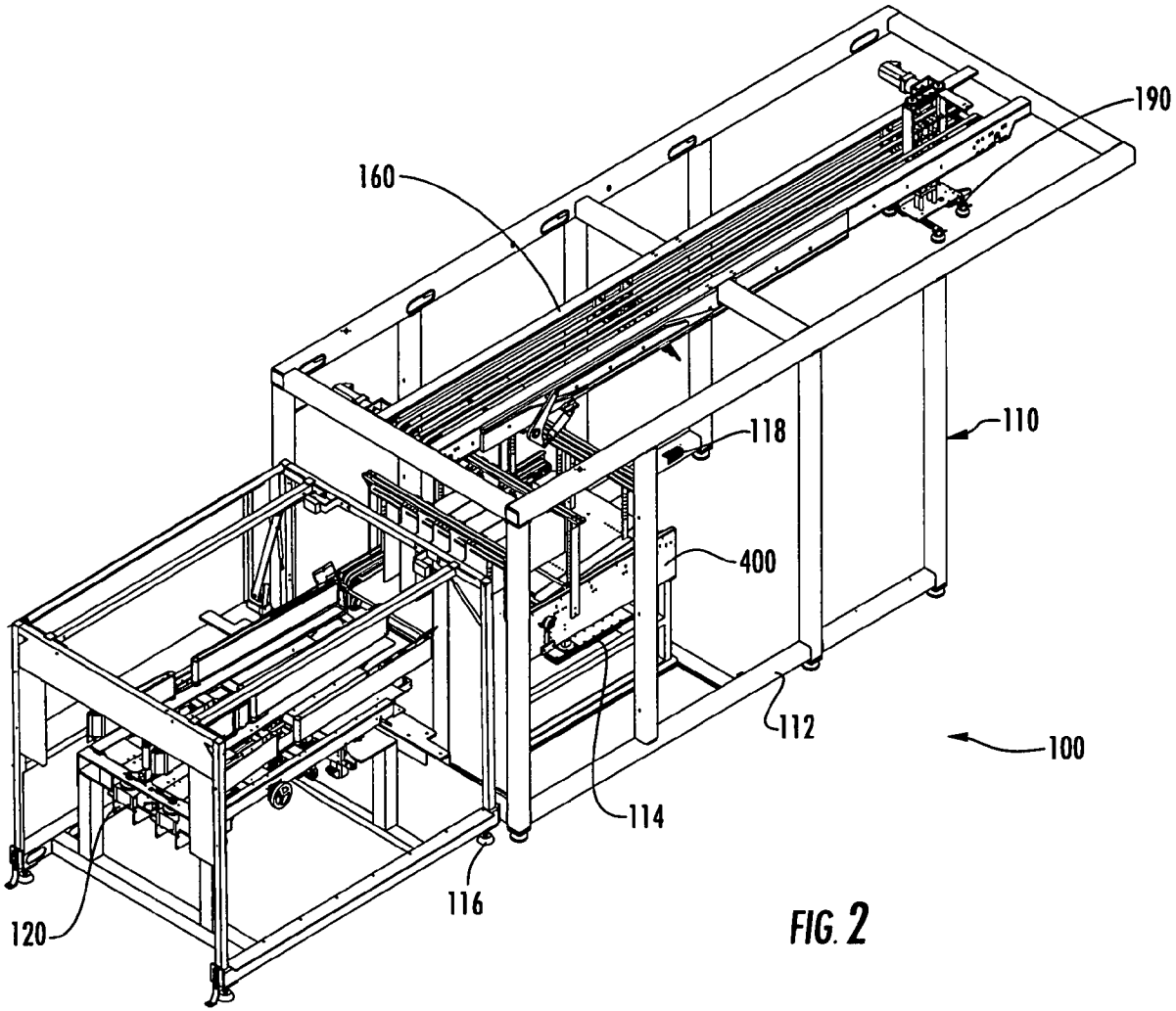
FIG. 2 is a front perspective view of a base system according to an exemplary embodiment.

Referring to FIGS. 1 and 2, the base system 100 is shown to include a base frame system 110, a diverter system 120, a flight bar conveyor system 400, a loader/transport system 160, an electrical system 170, a controller system 180 and a pneumatic system 190 according to an exemplary embodiment.

Figure 7:
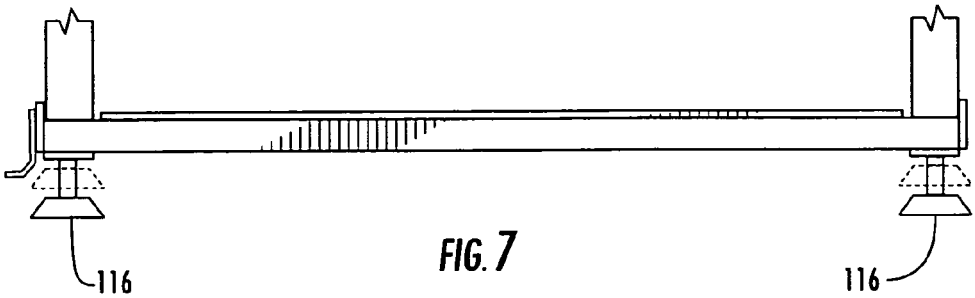
FIG. 7 is a side view of a leveling pad according to an exemplary embodiment.
Figure 8:
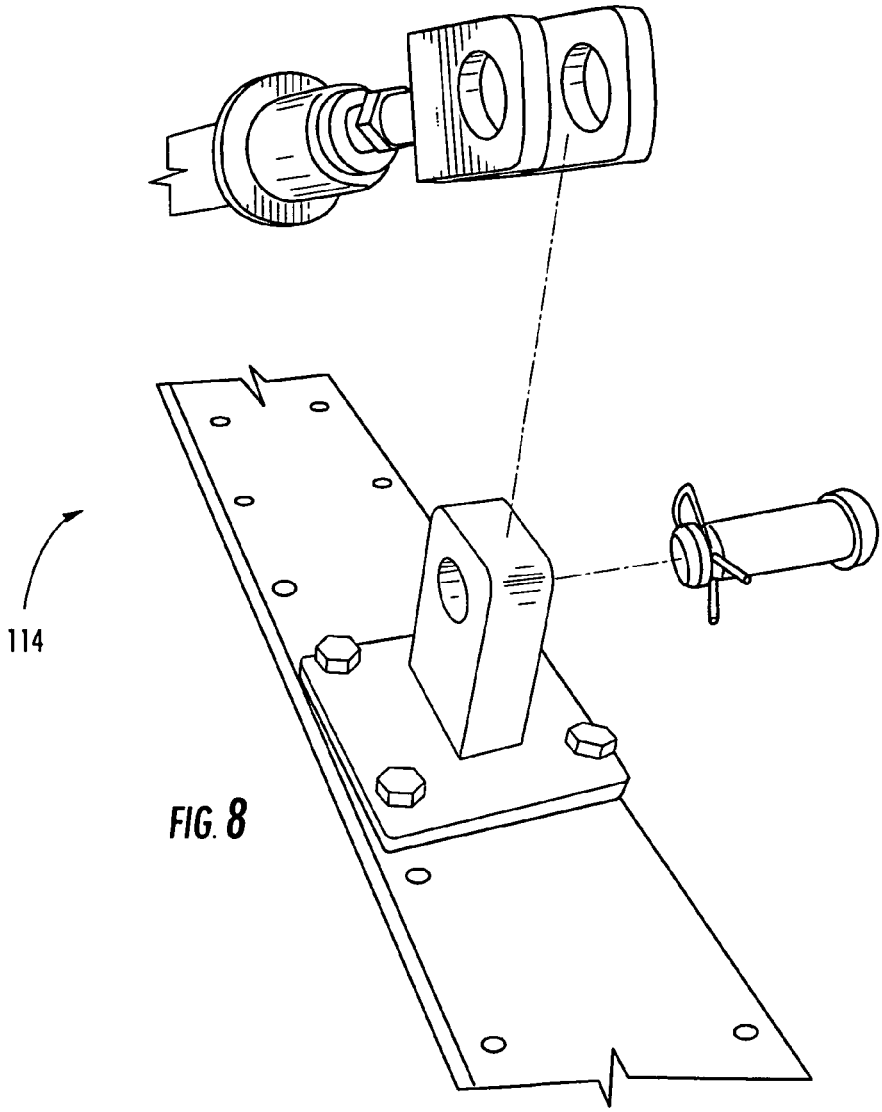
FIG. 8 is an isometric view of a hinge and pin connector according to an exemplary embodiment.

Again referring to FIG. 2, the base frame system 110 is shown to include multiple structural members 112 to support the systems and components of the base system 100. The structure of the base frame system 110 is configured to be used with an interchangeable packaging module 50. The base system 100 maybe physically connected to an interchangeable packaging module 50 (e.g. by mechanical, electrical, pneumatic connectors) or may be free standing (e.g. base system 100 is placed next to an interchangeable packaging module 50). Attached to the base frame system 110 is a module connect bracket 114 (as shown in FIG. 8) intended to couple the interchangeable packaging modules 50 to the base system 100. Attached to the base frame system 110 are multiple alignment devices (shown as leveling devices 116, as shown in FIG. 7, and guide pads 118) that are intended to aid in leveling and/or aligning the base system 100 and the packaging module 50. In an alternative embodiment, the base frame system 110 may contain, for example, a rail or a spline that is configured to receive a mating rail or spline on an interchangeable packaging module 50. The frame structural members 112 are configured to provide a housing to contain wires, hoses, lines, etc. This may be done, for example, by having a hollow core inside the structural member and having access ports at various locations (as shown, for example, in FIG. 2).

Figure 3:
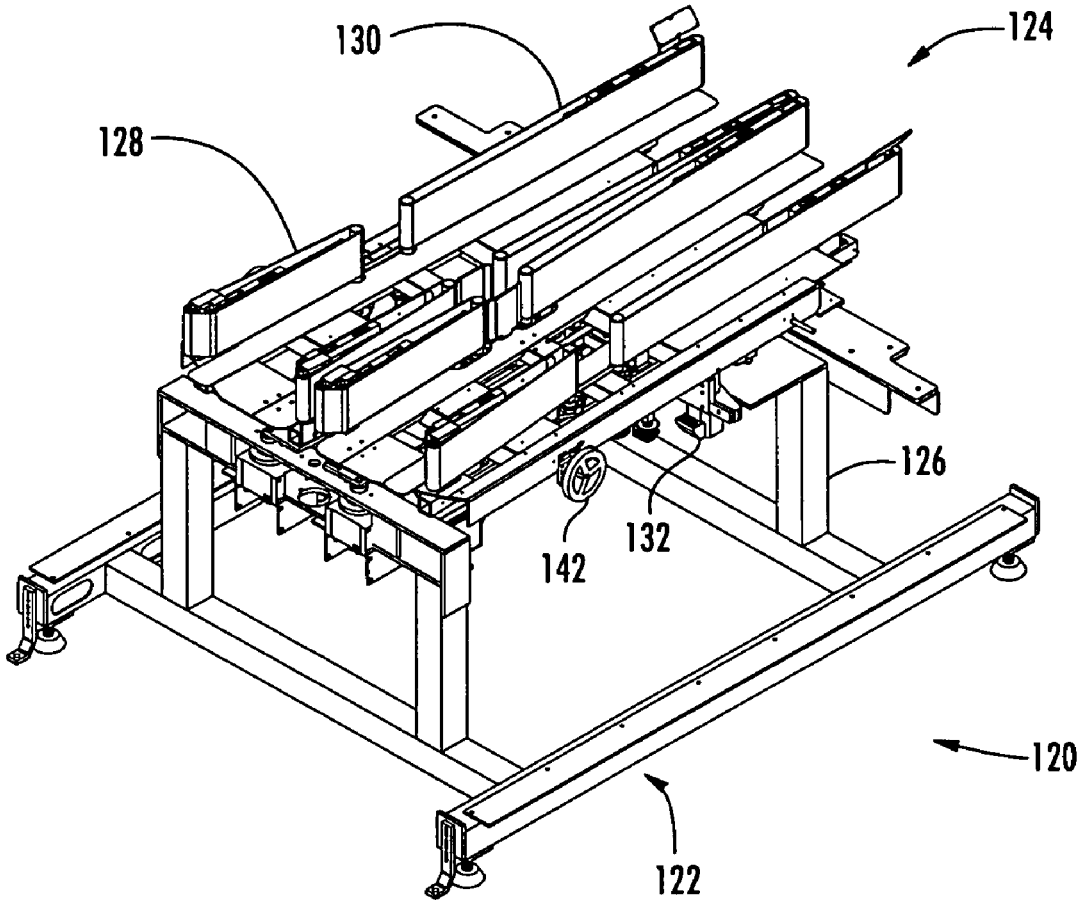
FIG. 3 is a front perspective view of a diverter system shown without a frame and guard system according to an exemplary embodiment.

Referring to FIG. 3, the diverter system 120 is shown to include a diverter frame and guard system 122 and an actuating lane diverter system 124. The diverter frame and guard system 122 is shown to include structural and support members 126 and guards 12 (shown in FIGS. 1-3). The actuating lane diverter system 124 is shown to include a choke conveyor system 128 and a speed up conveyor system 130.

Figure 4A:
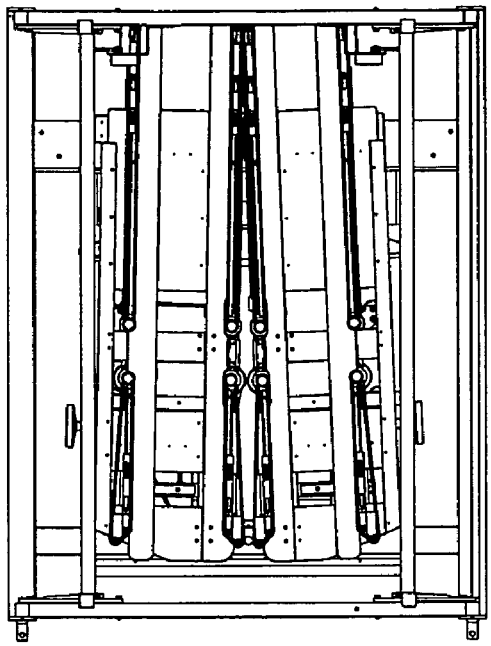
FIG. 4A is a top view of a diverter system according to an exemplary embodiment.
Figure 4B:
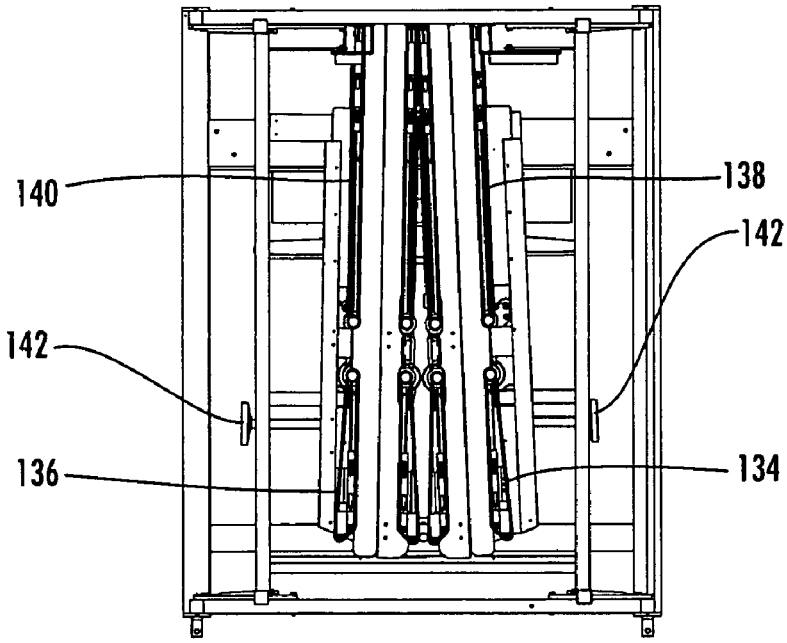
FIG. 4B is a top view of a diverter system according to an exemplary embodiment.

Referring to FIGS. 3, 4A and 4B, the choke conveyor system 128 includes a drive motor 132 (shown, for example, as a servo motor), a first drive device 134 (shown, for example, as a conveyor belt) and a second drive device 136 (also shown, for example, as a conveyor belt). The speedup conveyor system 130 is shown to include a first drive device 138 (shown, for example, as a conveyor belt) and a second drive device 140 (also shown, for example, as a conveyor belt). According to the illustrated embodiment, a single adjustment device 142 is provided to adjust the width between the first drive device 134, 138 and the second drive device 136, 140 of both the choke conveyor system 128 and the speedup conveyor system 130 to allow for various sizes of product widths (e.g., 3.5 inches-13.5 inches) or other suitable size.

Products may be moved to the diverter system 120 by any conventional product conveyor infeed system known in the art. For example, products may arrive in a single lane, in two lanes, or more than two lanes. The products are then divided into various lane configurations by the actuating lane diverter system 124. According to one exemplary embodiment, up to six lanes of product can be created. According to an alternative embodiment, multiple vertical lanes of product can be created. Actuation of the actuating lane diverter system 124 may be achieved, for example, by a servo drive motor.

The choke conveyor system 128 advances the product forward at a first speed. The speedup conveyor system 130 advances the product forward at a second speed, faster than the first speed. The faster speed of the speedup conveyor 130 produces a gap between successive products; this gap is used in subsequent product handling by the flight bar conveyor system 400. The choke conveyor system 128 and the speedup conveyor system 130 may be driven by a single drive motor, for instance, the servo drive motor of the choke conveyor system 128. The faster speed of the speedup conveyer system 130 may be achieved, for example, by a suitable gearing arrangement, or other conventional equipment. In an alternative embodiment, the faster speed of the speedup conveyer system 130 may be achieved by using a single drive belt, but by using a different size pulley than a choke conveyor system pulley. In another alternative embodiment, each conveyor system may be driven by its own drive motor.

Figure 5:
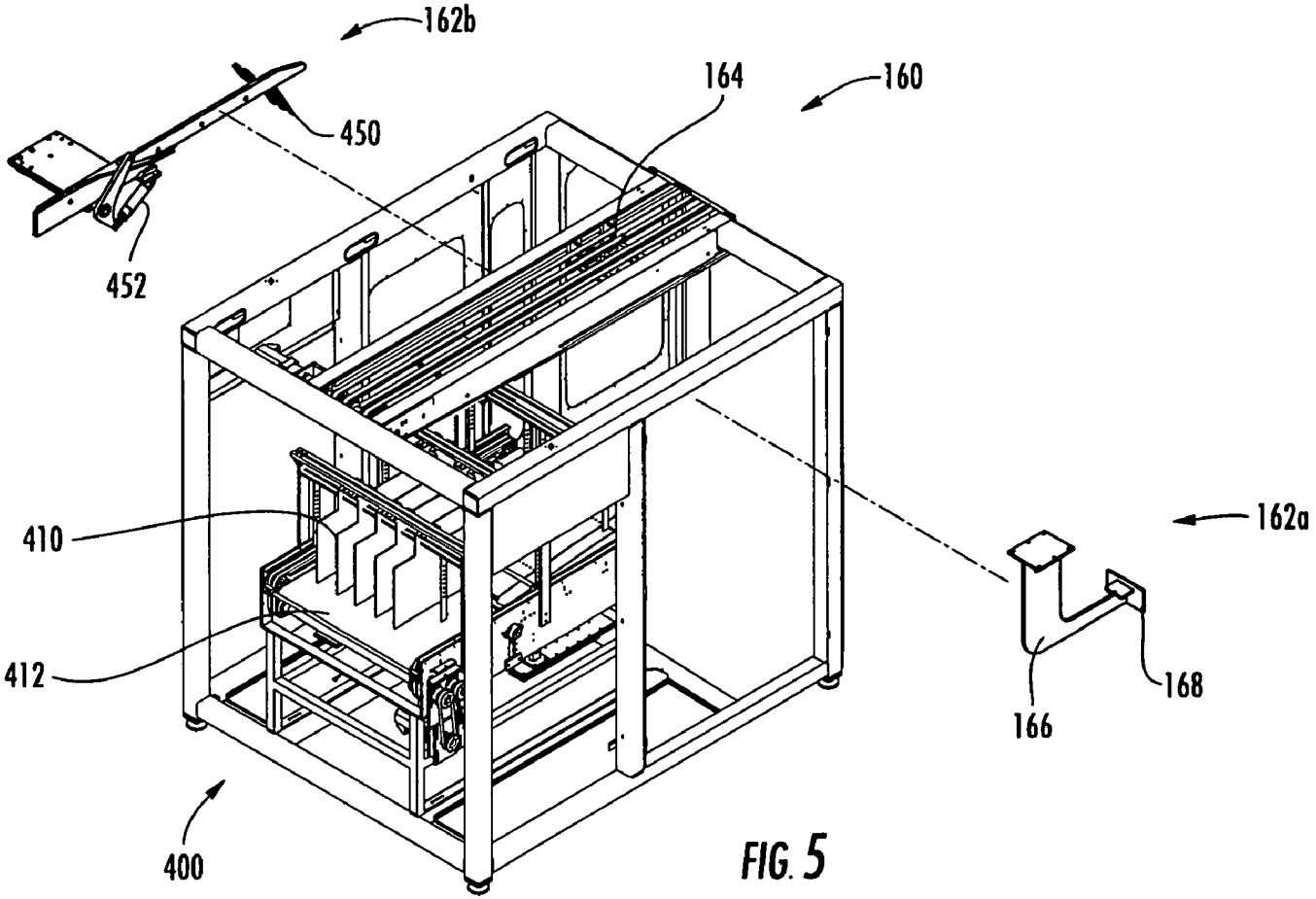
FIG. 5 is a front perspective view of a base system according to an alternative embodiment and a flight bar conveyor system according to an exemplary embodiment.
Figure 6A:
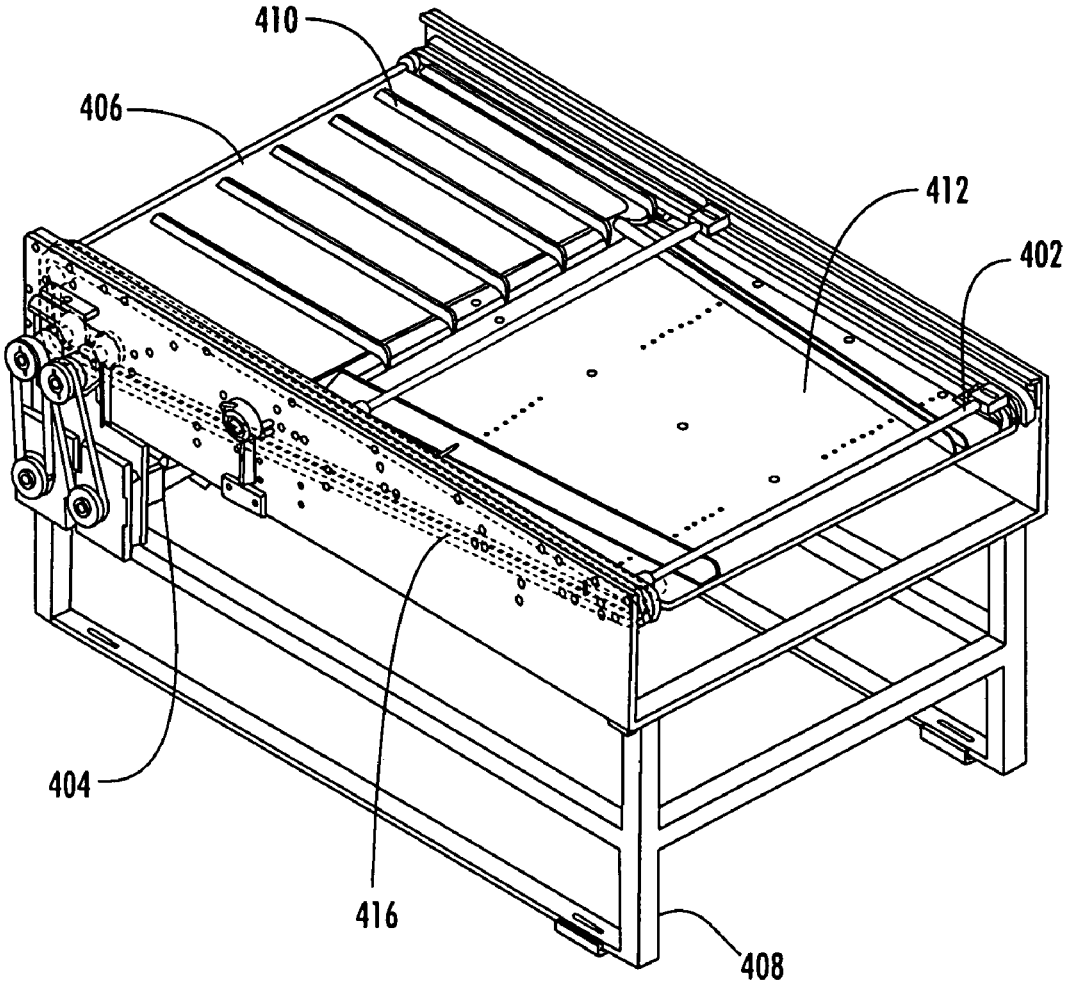
FIG. 6A is an isometric view of a flight bar conveyor system according to an exemplary embodiment.
Figure 6B:
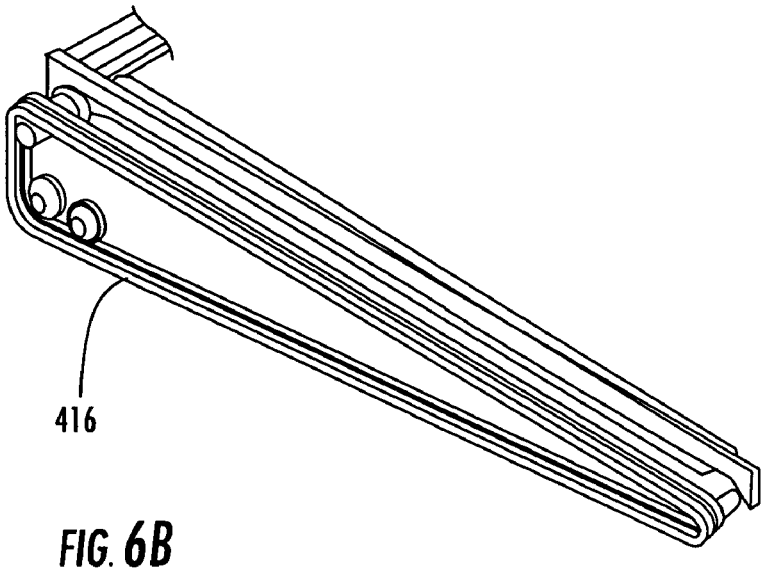
FIG. 6B is an isometric view of a flight bar conveyor drive system according to an exemplary embodiment.
Figure 6C:
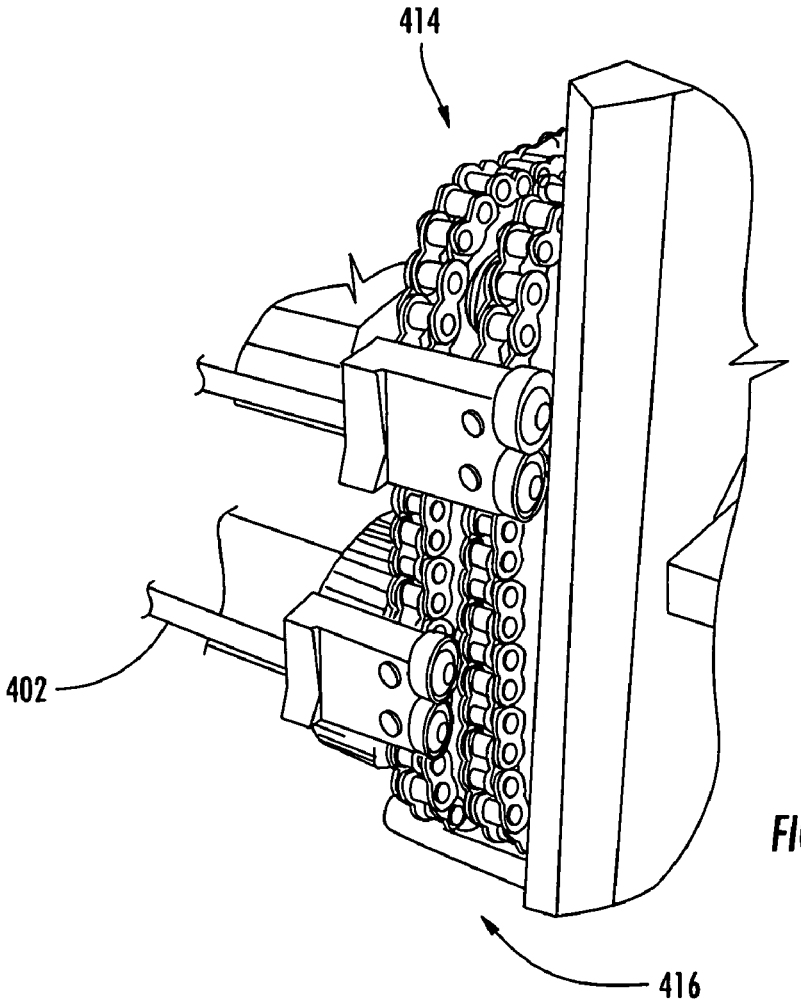
FIG. 6C is an isometric view of a flight bar conveyor drive system according to an exemplary embodiment.

Referring to FIGS. 5, 6A, 6B and 6B, the flight bar conveyor system 400 is shown to include multiple flight bars 402, multiple drive motors 404 (e.g. servo motors), a conveying system 406 and structural members 408. The conveying system 406 is shown to include lane dividers 410, a platform 412, and multiple drive systems 414. The drive systems 414 are shown to include multiple drive devices 416 (e.g. belts, chains, pulleys, chain sprockets, etc.).

According to the illustrated embodiments, products are moved to the flight bar conveyor system 400 by the diverter system 120. Products are moved forward in a substantially uniform row on the platform by a flight bar 402. According to a preferred embodiment, there are two flight bars 402 per drive system 414, for a total of four flight bars 402 (two for each of the two drive systems 414). Each drive system 414 operates independent of the other drive systems 414, allowing for independent loading and unloading of products. The drive device 416 is shown to be longer along the underside of the platform 412 than the topside of the platform 412 to allow the first drive system 414 to unload a product by one fight bar 402 before a product is loaded by the second flight bar 402 of the first drive system (as shown by FIGS. 6A and 6B).

Referring to FIG. 5, the loader/transport system 160 is shown to include a loader/transport device 162 and a trolley rail system 164. According to an exemplary embodiment, the loader/transport device 162 is an L-shaped element 166 rigidly coupled to a plate 168 configured to move product(s). According to an alternative embodiment, the loader/transport device 162 may include multiple finger elements 450 rigidly coupled to an arm element 452. In another alternative embodiment, the loader/transport device may consist of two arm elements 452 rigidly coupled to multiple finger elements 450.

Referring to FIG. 5, the loader/transport system 160 is shown attached to the base system 100. In an alternative embodiment, the loader/transport system 160 may be attached to an interchangeable packaging module 50.

Figure 11:
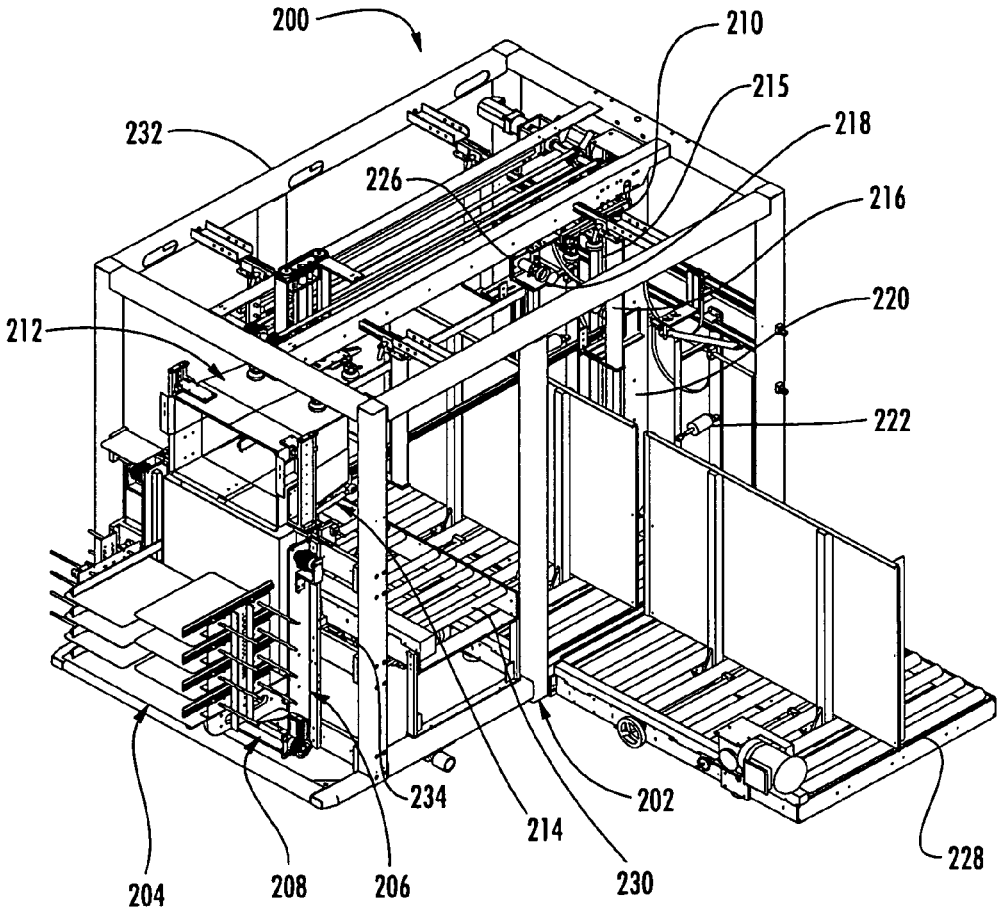
FIG. 11 is a front perspective view of an interchangeable case-packer module according to an exemplary embodiment.
Figure 14:
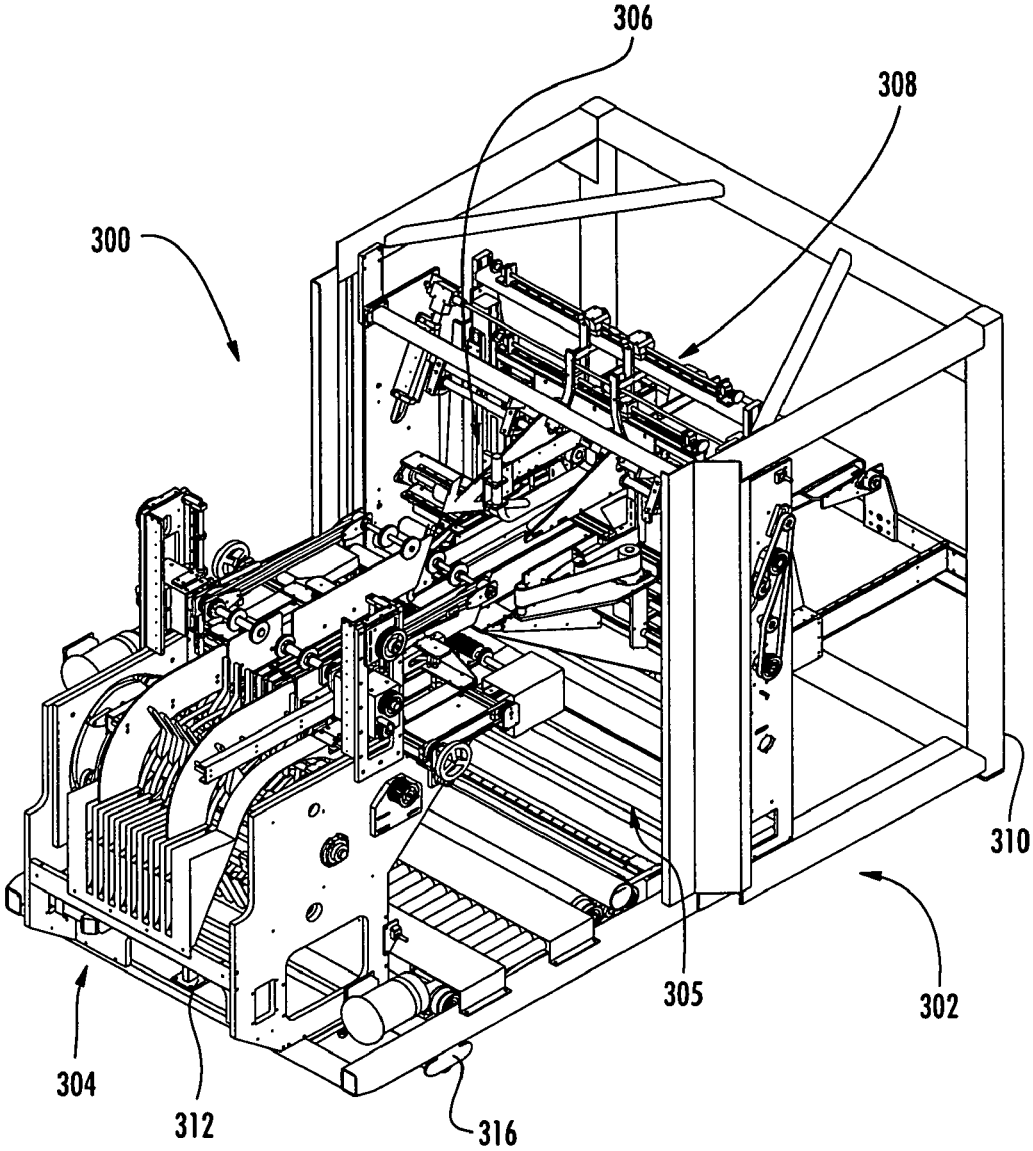
FIG. 14 is a front perspective view of an interchangeable bundler module according to an exemplary embodiment.

Referring to FIGS. 5 and 11, in a case-packing operation, the loader/transport system 160 moves product(s) from a cassette system 204 to an open case that is around a horn system 212. Referring to FIGS. 5 and 14, in a bundling operation, the loader/transport system 160 moves product(s) from an upender table 326 to a former system 306.

Figure 9:
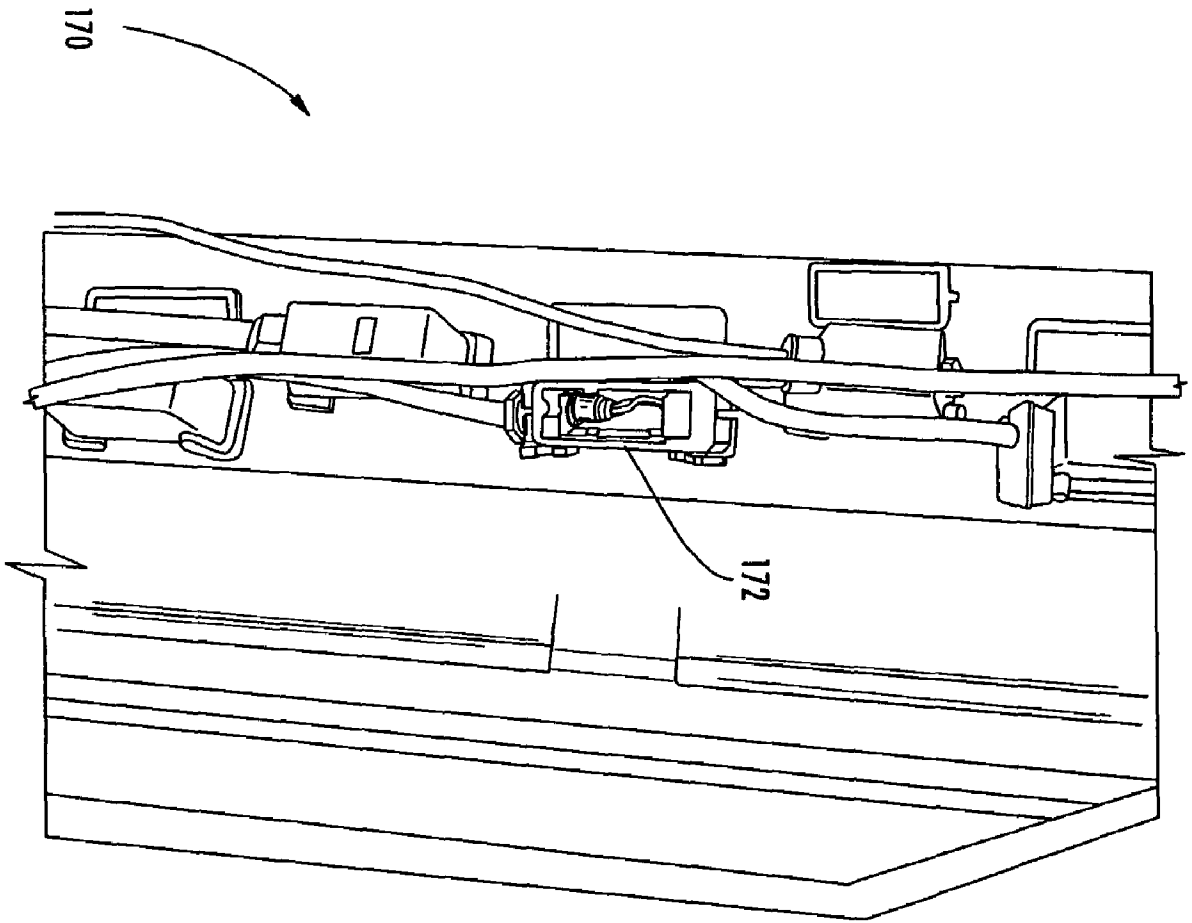
FIG. 9 is an isometric view of an electrical connection according to an exemplary embodiment.
Figure 10A:
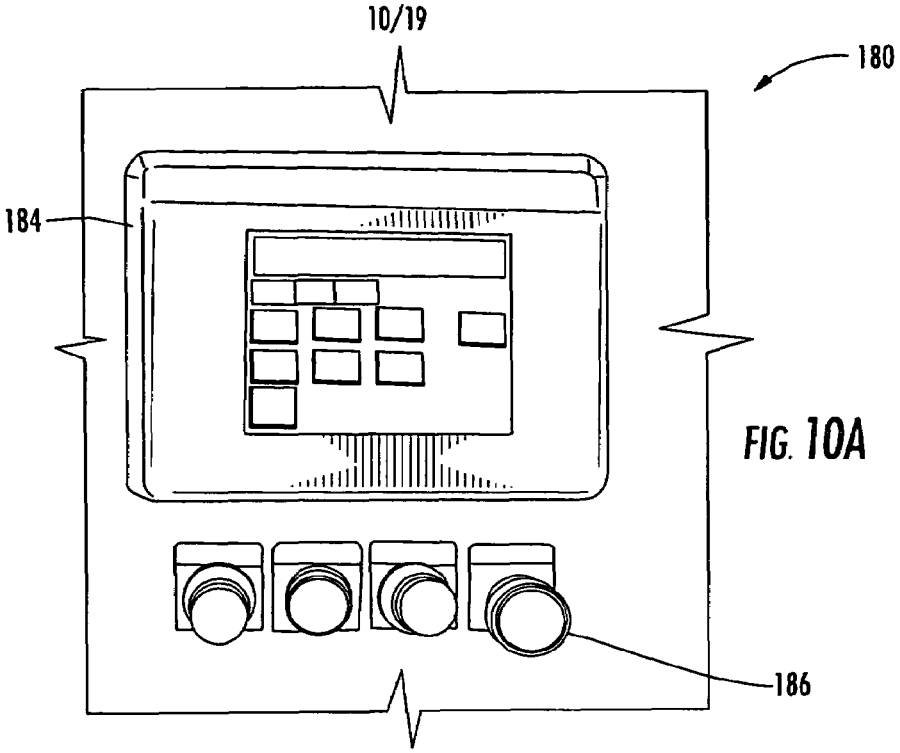
FIG. 10A is an isometric view of system according to an exemplary embodiment.
Figure 10B:
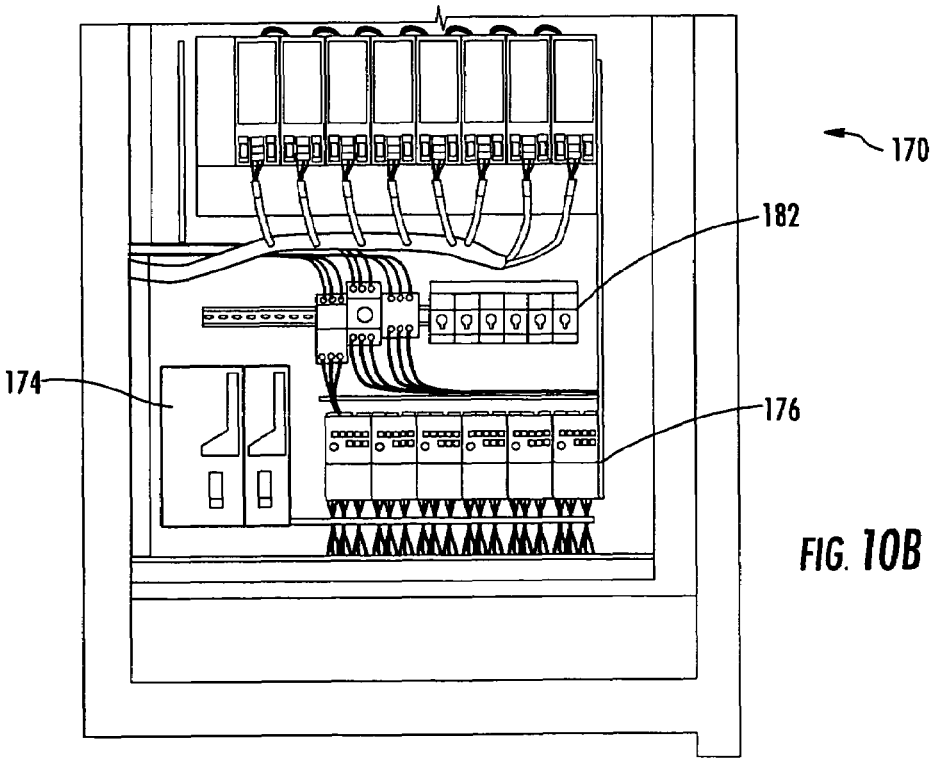
FIG. 10B is a isometric view of an electrical system and a controller system according to an exemplary embodiment.

Referring to FIGS. 9, 10A and 10B, an electrical system 170 is shown to include multiple electrical connectors 172 (e.g. connectors that allow multiple circuits through one plug connector such as those commercially available as Phoenix Contact), an air conditioner 174 and multiple drive motor amplifiers 176 (e.g. servo motor amps, AC motor amplifiers) according to an exemplary embodiment.

Remote monitoring (e.g. video, data, troubleshooting, electrical, mechanical, process control) of the modular packaging system 10 may be accomplished, for example, through an Ethernet or similar networking device (e.g. wireless connection, router, etc.). Remote I/O may be accomplished, for example, by an Ethernet connection. In a preferred embodiment, each interchangeable packaging module has a separate IP address intended to allow auto recognition when connected to the base system. Use of an Ethernet connection between the base system 100 and the individual packaging module 50 is intended to aid in a speedy change over between modules (e.g. connecting a single connection instead of connecting multiple (e.g. 50) connections).

Referring further to FIG. 10A, a controller system 180 is shown to include a controller 182 (e.g. programmable logic controller), an interface device 184 (e.g. touch screen) for interfacing with the controller 182 and a safety control circuit 186. The interfacing device 184 may be located, for example, directly on the base system 100. According to an alternative embodiment, the interfacing device 184 may be located on a swing arm. According to an exemplary embodiment, the controller system 180 automatically recognizes the type of interchangeable packaging module 50 that is connected to the base system 100. According to an exemplary embodiment, a specific set of user interface screens are available to the user based on the type of interchangeable packaging module 50 that is connected to the base system 100. According to a preferred embodiment, the user interface screens for the base system components are the same regardless of which interchangeable packaging module 50 is connected to the base system 100 and is intended to reduce the amount of training needed to train users of the modular packaging system 10.

Case-Packer Module

Referring to FIG. 11, a case-packer module 200 is shown to include a case-packer frame system 202, a cassette system 204, a cassette lift frame system 206, a cassette lift carriage system 208, an adjustable horn system 212, a chair system 214, a knockdown transport system 210, a knockdown guide track side air cylinder system 216, a knockdown lift system, a knockdown lift frame system, a knockdown back fold system 222, an outside knockdown conveyor system, a knockdown side clamping system 226, a knockdown conveyor infeed system 228 and a case exit conveyor system 230. A knockdown refers to a case (made from cardboard, for example) in a flat configuration.

Figure 12A:
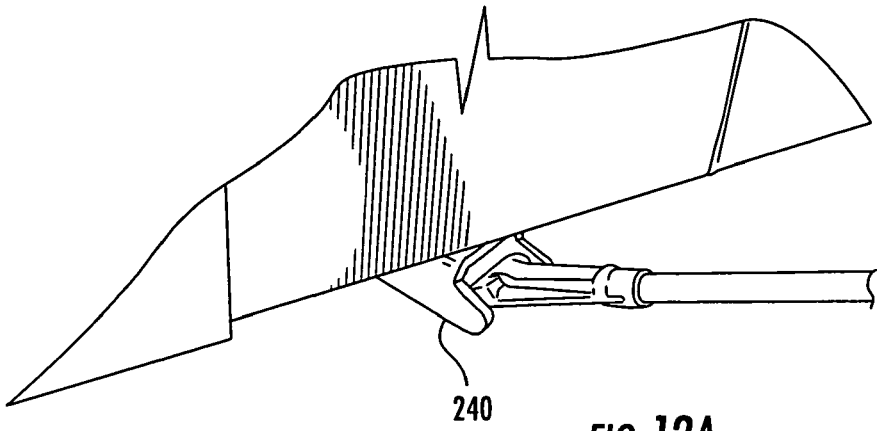
FIG. 12A is an isometric view of a caster according to an exemplary embodiment.
Figure 12B:
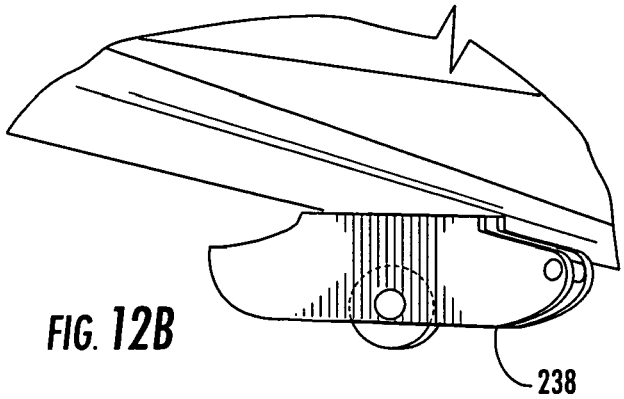
FIG. 12B is an isometric view of a caster according to an exemplary embodiment.
Figure 12C:
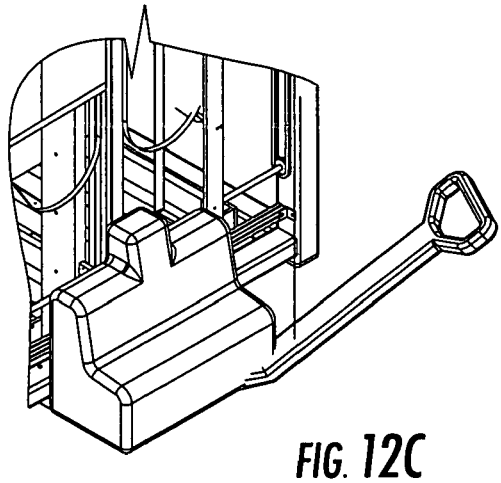
FIG. 12C is an isometric view of a self driven wheel according to an exemplary embodiment.

Referring to FIGS. 11, 12A, 12B and 12C, a case-packer frame system 202 is shown to include multiple structural and support members 232, a module connect hitch 234, multiple roller casters 238 intended to aid in the movement of the case-packer module 200 and a swivel roller caster 240 intended to aid in the turning of the case-packer module 200 during movement. The case-packer module 200 may be moved by a transport device, for example, by hand, by forktruck, or be self driven, as shown in FIGS. 12A, 12B and 12C. A self driven (self propelled) transport device maybe powered by, for example, a gas engine, a propane engine, or an electric battery.

Referring to FIG. 11, a cassette system 204 is shown to include multiple product guide panels (cassette paddles), a platform (cassette dead plate), a device for adjusting the width of the cassette paddles and multiple structural members used to slidably couple the cassette system 204 to the case-packing module.

Referring to FIG. 11, a cassette lift frame system 206 is shown to include multiple cassette lift mounting plates, multiple cassette lift guides, multiple cassette lift frames, a cassette lift plate, a cassette lift shaft, multiple pulleys, multiple of cassette lift shafts, a cassette lift motor mount, a cassette lift motor bracket, a multiple pulley bracket supports, a gear box, multiple radial bearings, multiple pulleys, a belt, multiple bushings, and a servo motor.

Referring to FIG. 11, a cassette lift carriage system 208 is shown to include multiple cassette lift carriage plates, multiple belt tensioner blocks, multiple loader carriage mounts, multiple belt tensioner blocks, multiple loader carriage mounts and multiple cam bearings.

Products enter the cassette system 204 via the flight bar conveyor system. The flight bar unloads a product row onto the cassette dead plate. If required, multiple product rows may be stacked on top of one another to create multiple product layers. This may be done by adjusting the vertical height of the cassette system 204 by one product height. Optional cassette shelf panels may also be employed when stacking multiple product rows according to an alternative embodiment. Additionally, multiple product rows may be grouped together to produce various product row depths. Once the desired product stack configuration is obtained, the product stack is pushed forward via the loader/transport system into an open case.

Figure 13A:
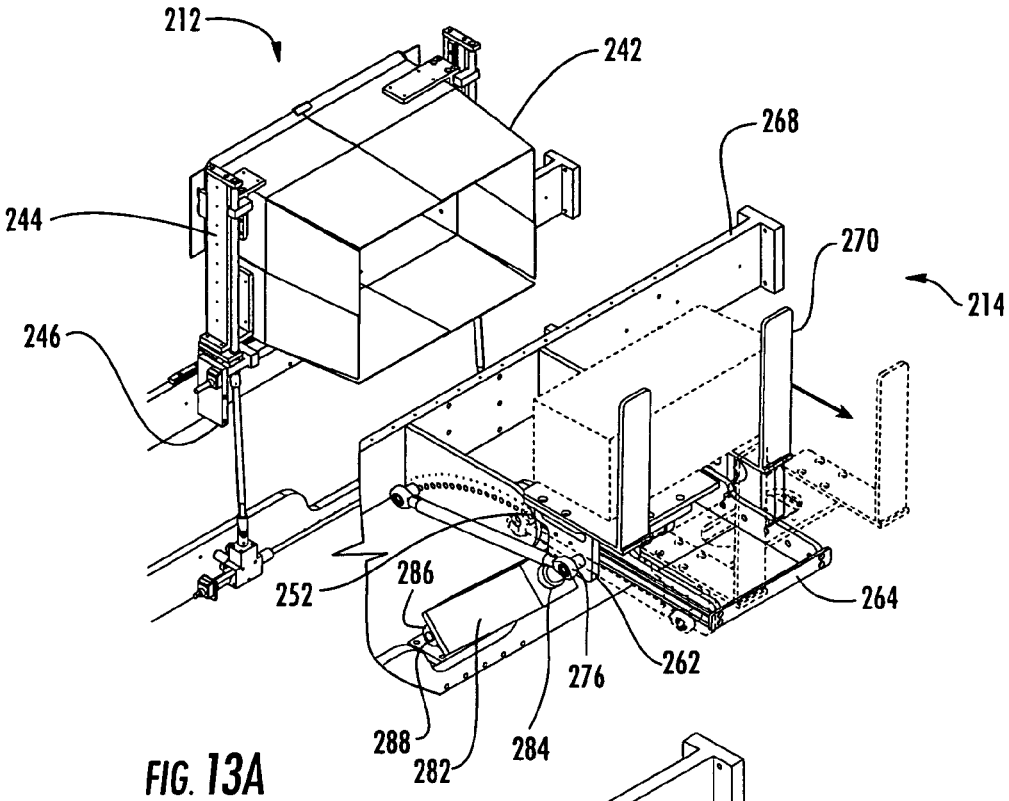
FIG. 13A is a rear perspective view of an adjustable horn system and a chair system according to an exemplary embodiment.
Figure 13B:
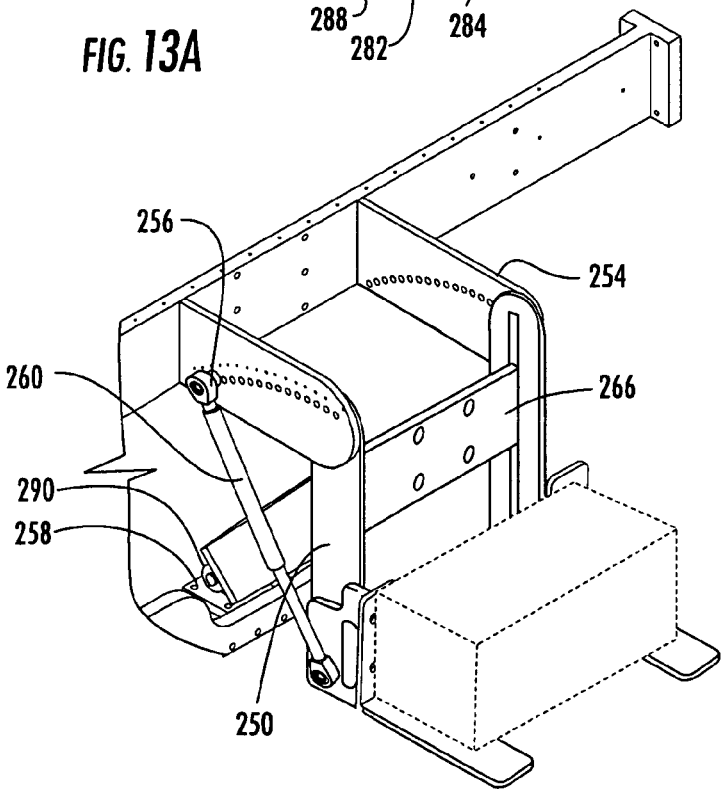
FIG. 13B is a rear perspective view of a chair system according to an exemplary embodiment.

Referring to FIGS. 13A and 13B, an adjustable horn system 212 is shown to include multiple overlapping panels 242 (made, for example, from sheet metal, plastic or cardboard) and multiple support members 244 which couple the adjustable horn 212 to the case-packing module 200. An adjustment device 246 is provided to adjust the horn system 212 in a first direction (height) and a second direction (width). Adjustment in a third direction (depth) is generally not required due to the adjustability of a chair system 214, which facilitates setup, maintenance and changeover between different products.

Referring to FIGS. 13A and 13B, a chair system 214 is shown to include multiple chair pivot plates 250, multiple chair pivot shafts 252, multiple chair adjustment plates 254, multiple chair adjustment spacers 256, a chair cylinder clevis support 258, multiple chair arm tubes 260, multiple chair connecting arm brackets 262, an arm spacer plate 264, multiple chair plates 266, multiple cassette mounting tie-bars 268, multiple chair arms 270, multiple rod end ball bearings 276, an air cylinder 282, an air cylinder shaft 284, multiple air cylinder pivots 286, multiple air cylinder shaft pins 288, and an air cylinder shaft pivot end 290.

The chair system 214 is shown in the product loading position in FIG. 13A. The chair arms 270 butt up against the bottom side of the case. The position of the chair arms 270 is adjustable via the various chair shaft mounting holes in the chair adjusting plates 254 to adapt to various case depth positions. This is accomplished, for example, by pivotly attaching a first end of the chair arm tube 260 to one of the chair shaft mounting holes and pivotly attaching a second end of the chair arm tube 260 to a chair connecting arm bracket 262.

Once the stacked grouping of products are moved by the loader/transport system 160 from the cassette system 204 through the adjustable horn system 212 and into a case, the chair system 214 moves to the unloading position, as shown in FIG. 13B. The design of the chair system 214 allows for variability of case depths (as noted above) but keeps the unloading position height constant. Keeping the unloading position height constant eliminates any need to change the height of the case exit conveyor system 230. This is accomplished by, for example, pivotly attaching a first end of an air cylinder 282 to a first air cylinder shaft pivot end 290 and pivotly attaching a second end of an air cylinder 282 to a second air cylinder shaft pivot end 290. Actuating the air cylinder 282 moves the chair system 214 from the loading position to the unloading position. When the chair system 214 is set up to receive small case depths, the chair arms 270 slide along chair pivot plates 270 when the chair system 214 is moved from the loading position to the unloading position. When the chair system 214 is set up to receive large case depths, the chair arms 270 do not need to slide (or slide less) along chair pivot plates 270 when the chair system 214 is moved from the loading position to the unloading position.

Referring further to FIG. 11, a knockdown transport system 215 is shown to include a knockdown transport thruster support mount, a transport suction support plate, multiple transport suction mounts, a transport top flap closing arm, a knockdown top flap closing plate, multiple transport suction support plates, multiple transport spacers, a hand wheel stop bracket, a hand wheel clamp bracket, a threaded transport adjusting shaft (e.g. ACME threaded transport adjusting shaft), a transport adjusting plate, multiple transport height-adjusting stop spacers, a transport carriage height adjustment plate, a transport adjusting support, a transport carriage top support plate, a threaded transport adjusting shaft (e.g. ACME threaded transport adjusting shaft), a transport carriage adjusting shaft, multiple fasteners, a gear box, multiple bearings, multiple chain sprockets, a connecting link chain, multiple couplings, a pneumatic air cylinder, a linear thruster cylinder, multiple vacuum cups, multiple air cylinder mount brackets, and multiple spacers.

Referring further to FIG. 11, a knockdown guide track/side air cylinder system 216 is shown to include multiple case side cylinder adjustment plates, multiple case side air cylinder mounts, multiple knockdown side cylinder adjustment brackets, multiple knockdown transport guide mounts, a guide, multiple aluminum track extrusions, multiple linear bearings, multiple air cylinders and multiple vacuum cups.

Referring further to FIG. 11, a knockdown lift/erector system 218 is shown to include multiple loader carriage plates, a carriage lift support, a belt tensioning spacer, multiple adjusting knockdown lift brackets, multiple knockdown lift suction brackets, a cable track support plate, multiple cam bearings, multiple vacuum cups and a mounting bracket.

Referring further to FIG. 11, a knockdown lift frame system 220 is shown to include multiple carriage tracks, a gearbox, multiple pulleys, a taperlock bushing, an idler shaft, a servo motor, a knockdown lift frame, a motor mounting plate, and a cable track support.

Referring further to 11, a knockdown back fold system 222 is shown to include multiple knockdown side flap cylinder mounts, a knockdown side flap closing support right side, a knockdown side flap closing support left side, multiple knockdown side door clamp supports, multiple knockdown side flap closing adjustment plates, multiple knockdown side flap closing adjustment block supports, multiple knockdown side flap adjustment shaft support blocks, multiple shafts, a cassette frame, multiple counters, multiple aluminum tracks, multiple linear bearings, multiple bronze bushings, multiple pneumatic air cylinders and a knockdown lift frame system 220.

Referring further to FIG. 11, a knockdown side clamping system 226 is shown to include multiple knockdown side door clamp supports, multiple knockdown capturing supports, multiple knockdown capturing clamps, multiple knockdown capturing swivel brackets, multiple knockdown capturing brackets, multiple knockdown capturing threaded adjustment blocks (e.g. ACME threaded adjustment blocks), multiple knockdown capturing end blocks, multiple threaded adjusting shafts (e.g. ACME threaded adjusting shafts), multiple threaded knockdown capturing shafts (e.g. ACME threaded knockdown capturing shafts), multiple knockdown capturing spacer blocks, a cassette frame, multiple counters, multiple handwheels, multiple tracks, multiple linear bearings, multiple bronze bushing bearings, multiple rod end bearings, multiple chain sprockets, multiple chains, multiple pneumatic air cylinders and a knockdown lift frame assembly.

Referring further to FIG. 11, a knockdown infeed conveyor system 228 is shown to include a conveyor roller, a knockdown infeed conveyor frame, a knockdown infeed conveyor side frame, multiple conveyor rollers, a knockdown infeed conveyor drive guide, a knockdown infeed bottom support frame, a drive motor, a gear box reducer, a motor mounting plate, multiple motor support spacer mounts, a knockdown infeed chain guard, multiple knockdown infeed end frames, a chain, a knockdown infeed chain drive guard, multiple aluminum tracks, multiple threaded adjusting knockdown capturing shafts (e.g. ACME threaded adjusting knockdown capturing shafts), multiple bushings, a handwheel, multiple leveling pads, multiple chain sprockets, multiple aluminum linear-bearing extrusion guides, a knockdown capturing plate clamp, multiple pneumatic air cylinders, a knockdown capturing adjustment plate, a knockdown plate adjustment plate, multiple knockdown capturing plate supports, a mount banding bracket, and a banding to hold air lines.

Referring further to FIG. 11, a case exit conveyor system 230 is shown to include a case exit conveyor roller, a case exit conveyor frame, a case exit conveyor side frame, multiple conveyor rollers, a case exit conveyor drive guide, a case exit bottom support frame, a drive motor, a gear box reducer, a motor mounting plate, multiple motor support spacer mounts, a case exit chain guard, multiple case exit end frames, a chain sprocket, a chain and a case exit chain drive guard. According to an exemplary embodiment, the case exit conveyor maybe set up so a case can exit the modular packaging system 10 in either a right- or left-hand direction.

Bundler Module

Referring to FIG. 14, a bundler module 300 is shown to include a bundler frame system 302, an upender system 304, an unwind system 305, a former system 306 and a knife and exit conveyor system 308.

A bundler frame system 302 is shown to include multiple structural and support members 310, a module connect hitch 312, multiple roller casters 316 intended to aid in the movement of the bundler module 300 and a swivel roller caster intended to aid in the turning of the bundler module 300 during movement. The bundler module 300 may be moved by a transport device, for example, by hand, by forktruck, or be self driven, as shown in FIGS. 12A, 12B and 12C. A self driven (self propelled) transport device maybe powered by, for example, a gas engine, a propane engine, or an electric battery.

Figure 15:
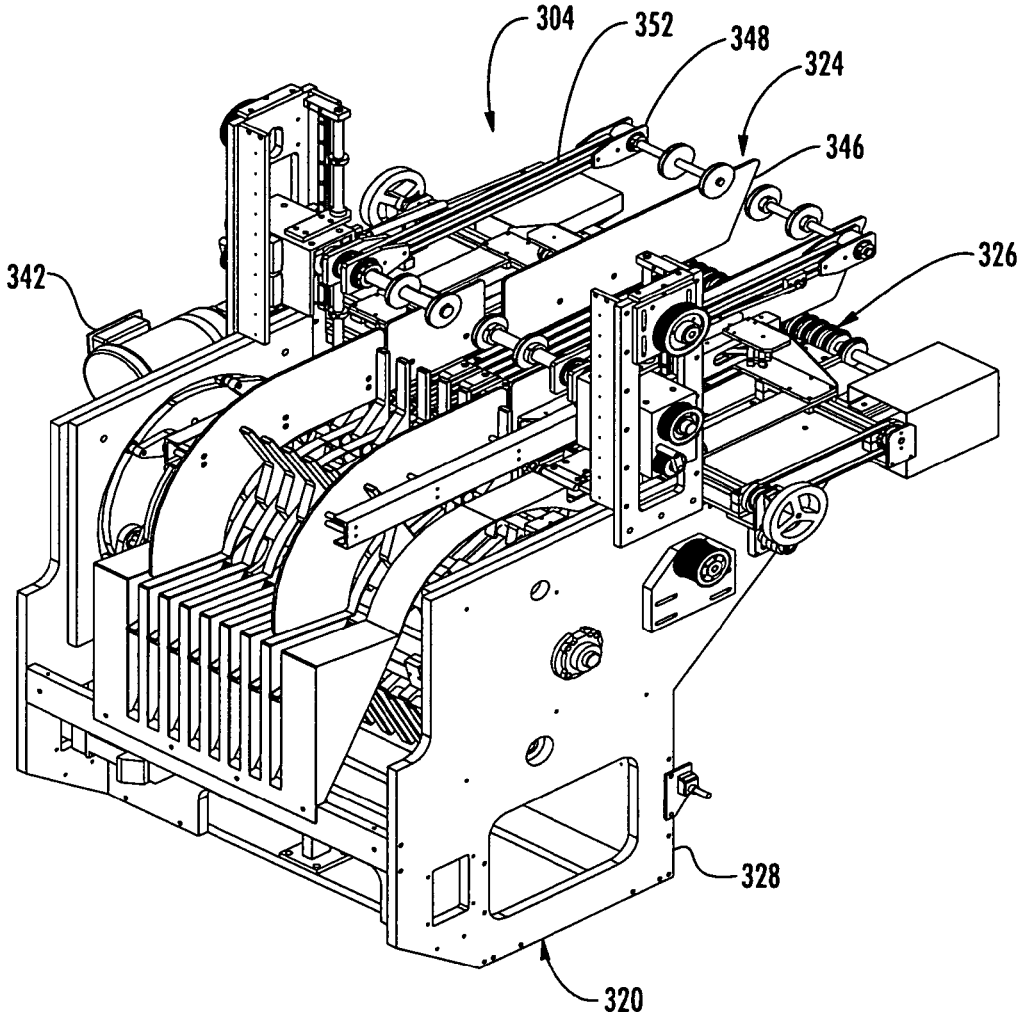
FIG. 15 is a front perspective view of an upender system according to an exemplary embodiment.
Figure 16A:
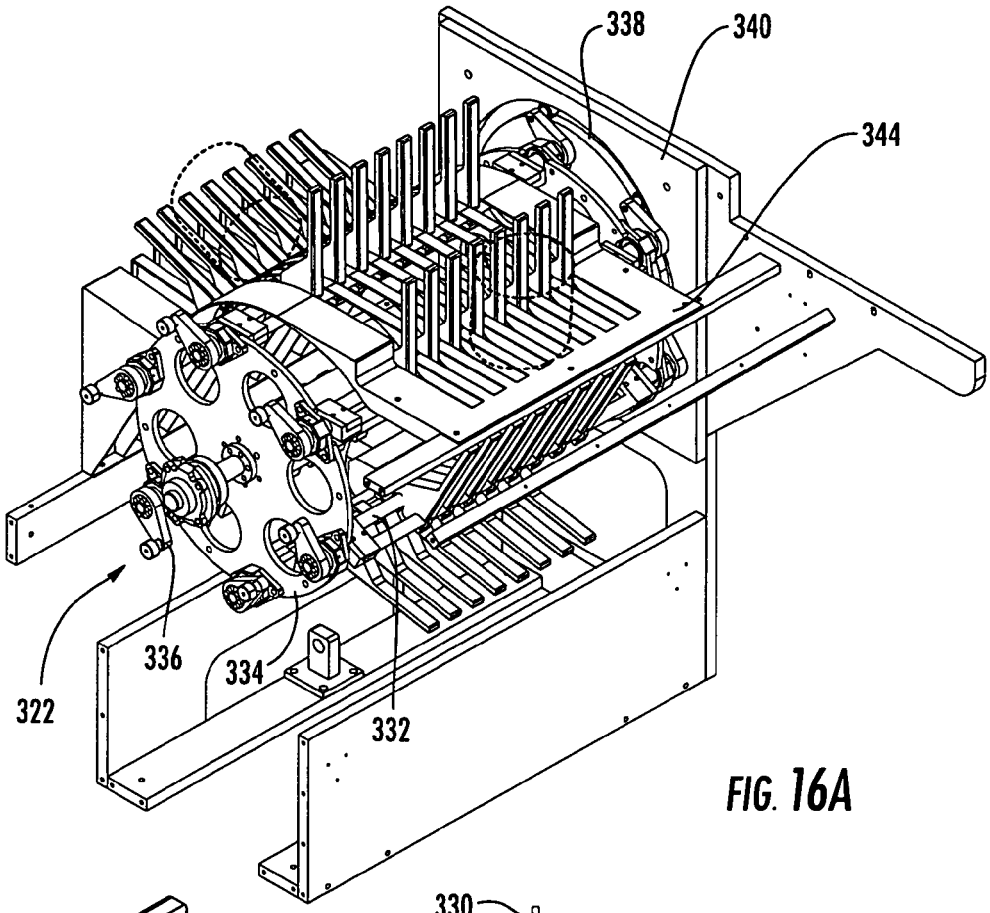
FIG. 16A is an isometric view of an upender system according to an exemplary embodiment.
Figure 16C:
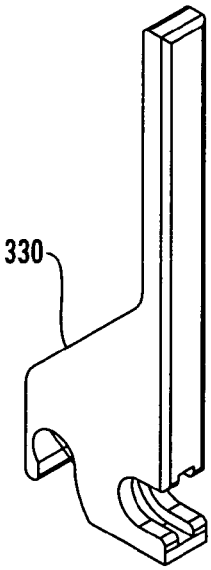
FIG. 16C is an isometric view of a finger according to an exemplary embodiment.
Figure 16B:
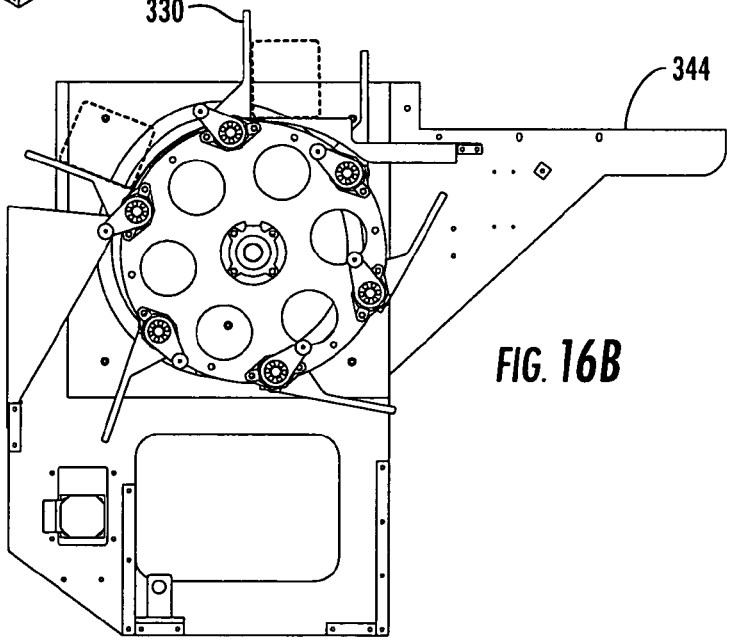
FIG. 16B is a side view of an upender system according to an exemplary embodiment.

Referring to FIGS. 15, 16A and 16B, an upender system 304 is shown to include an upender frame system 320, a spool system 322, a product guide system 324, and a table conveyor system 326. The upender frame system 320 is shown to include multiple structural and support members 328 to provide support for the upender system components.

Again referring to FIGS. 15, 16A, 16B and 16C, the spool system 322 is shown to a lifting device 330 (shown as multiple upender fingers) that are linearly coupled to a spool shaft 332. According to a preferred embodiment, there are six lines, or spool shafts, of upender fingers 330. According to a preferred embodiment, there are eight upender fingers 330 per line. However, any arrangement of fingers and lines may be possible. In an alternative embodiment, the lifting device may be a paddle of any shape or size, a grid, a mesh, a horizontal rod or vertical rod. The spool shafts 332 are rotationally coupled to a spool wheel 334 on both ends of the spool shaft 332 via a cam following device 336, shown here as a cam follower. A first end of the cam following device 336 is rotationally attached to the spool wheel 334; a second end of the cam following device 336 is inserted into a cam groove 338 in a cam plate 340. The cam plate 340 is attached to the upender frame system 320. The spool wheel 334 is driven by a drive motor 342, shown here as a servo motor. A platform 344 with slots that correspond to the upender fingers is rigidly coupled to the upender frame system 320 and provides a surface for a product to be upended by the upender fingers.

Further referring to FIGS. 16A and 16B, the cam action of the cam groove 338 and corresponding components provide for a product to be picked up in a first (horizontal) position and rotated 90 degrees to a second (vertical) position. In addition, once a product is in the vertical position, the cam action provides for the line of upender fingers 330 to remain vertical while moving the product forward. This ensures that the product(s) is not tipped over. Product(s) are then moved forward, for example, by a loading/transport system 160. According to an alternative embodiment, a conveyor system moves product forward from the upender system 304. According to another embodiment, the table conveyor system 326 comprises multiple individual conveyor belts that are arranged in between the upender fingers 330 of the upender system 304.

The product guide system 324 is shown to include multiple rectilinear panels 346 (e.g. product guide panels, side compression panels) and roller arms 348 to aid in guiding the product along a table conveyor system 326 as shown in FIG. 15. An adjustment device 350 is provided to adjust the distance between the rectilinear panels 346 to accommodate various product grouping sizes. The roller arms 348 are rotationally coupled to the upender frame system 320. Tension arms 352 are slidibly fixed to the roller arms 348 to keep pressure on products as they advance along the table conveyor system 326.

Figure 17A:
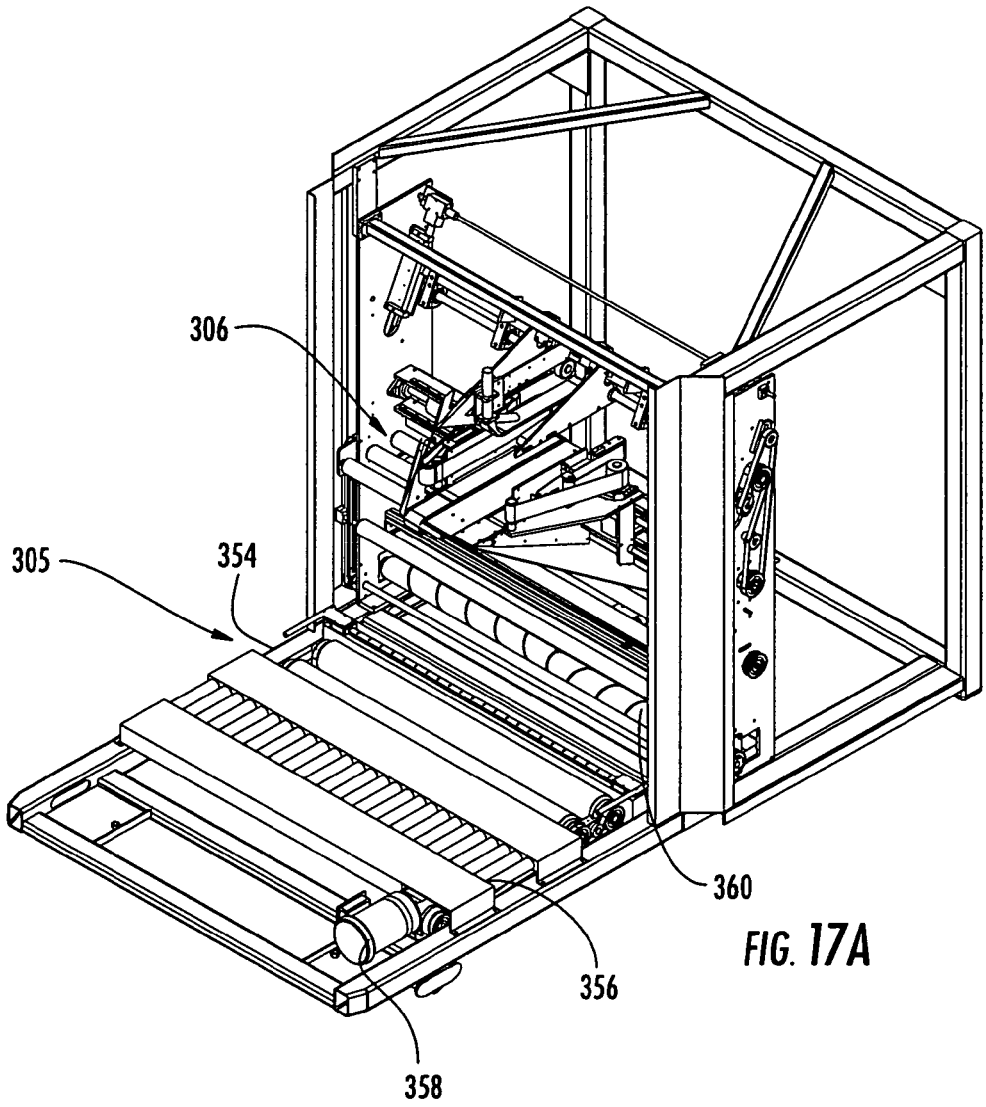
FIG. 17A is a front perspective view of a former and unwind system according to an exemplary embodiment.

Referring to FIG. 17A, an unwind system 305 is shown to include a frame system 354, a conveyor 356, a drive motor 358, and multiple unwind shafts 360.

Figure 17B:
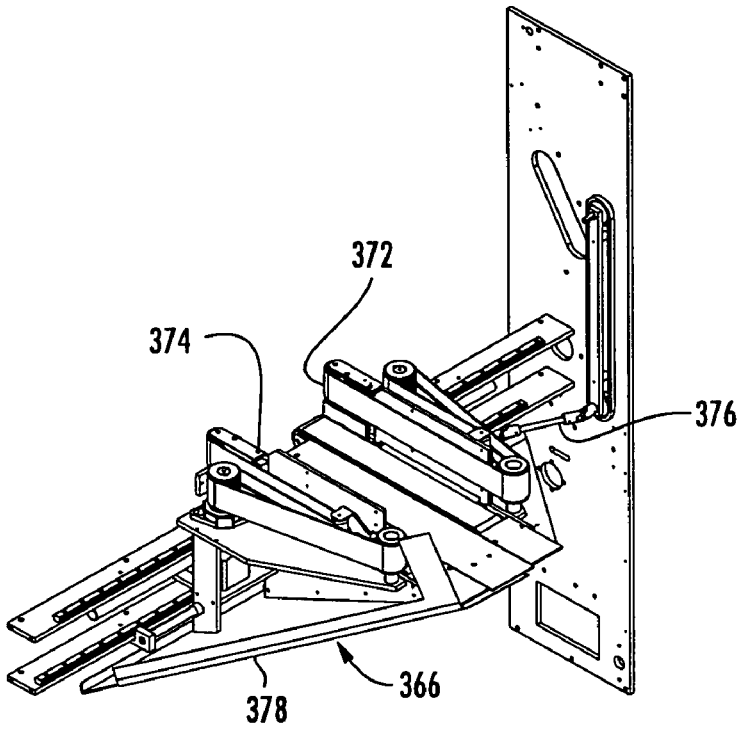
FIG. 17B is a front perspective view of a lower former system according to an exemplary embodiment.
Figure 17C:
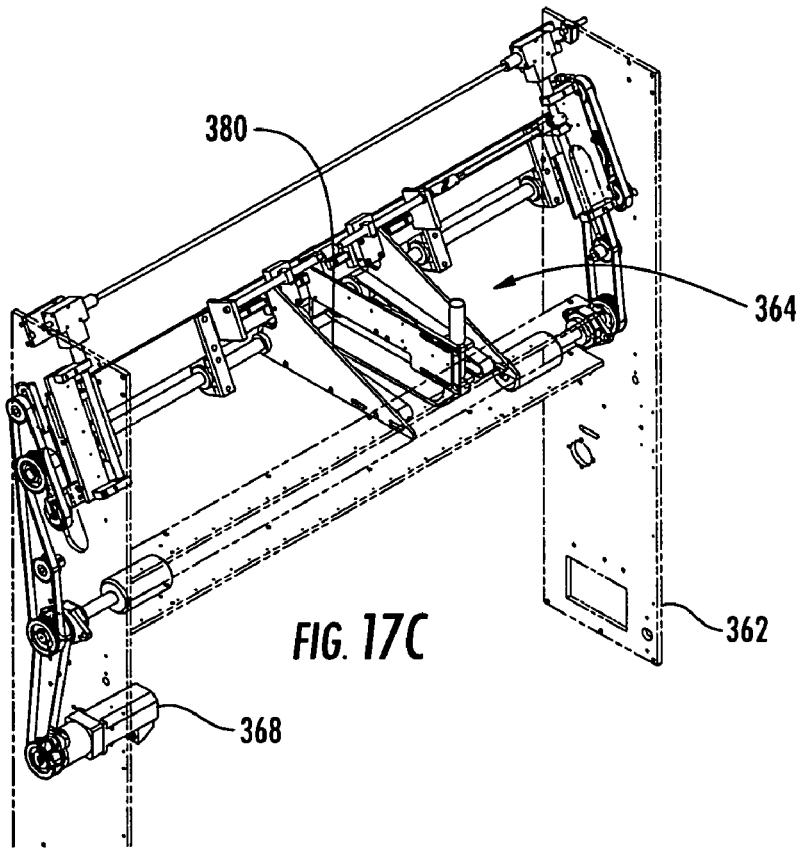
FIG. 17C is a front perspective view of an upper former system according to an exemplary embodiment.

Referring to FIGS. 17A, 17B and 17C, a former system 306 is shown to include a former frame system 362, an upper former system 364, a lower former system 366, a drive motor 368, multiple belts 372, an adjusting member 376, multiple forming plates 378 and a vacuum tube 380.

Figure 18A:
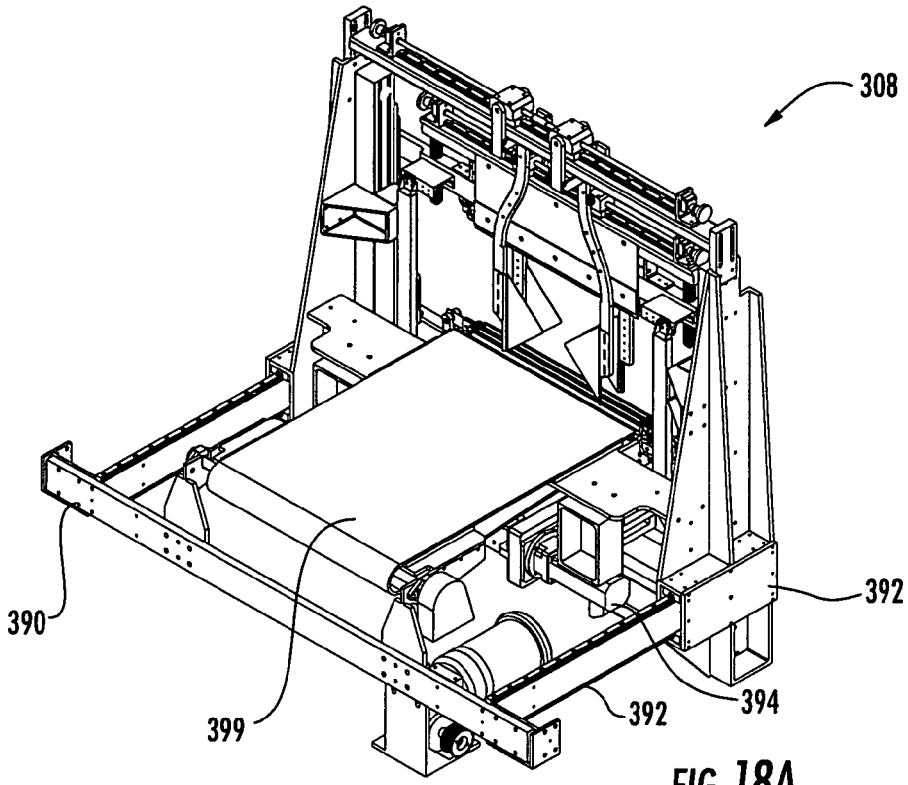
FIG. 18A is a rear perspective view of a knife and exit conveyor system according to an exemplary embodiment.

Referring to FIG. 18A, a knife and exit conveyor system 308 is shown to include a knife and exit conveyor frame system 390, a carriage 392, a drive motor 394, a folding jaw 396 a knife 398 and an exit conveyor 399.

Figure 18B:
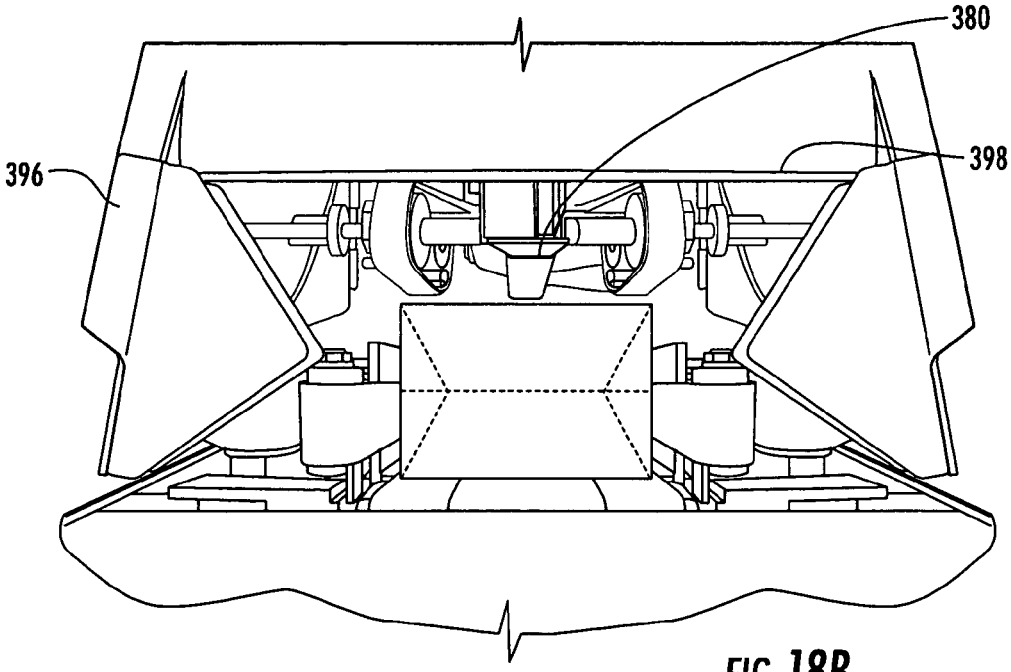
FIG. 18B is a rear view of a knife and exit conveyor system according to an exemplary embodiment.

A product grouping arrives into the former system 306 by being moved by the loader/transport system of the base system from the table conveyor system 326 of the upender system 304. A product grouping may also enter the former system 306 by a conveyor device, as shown in FIG. 18B. The product grouping is then bundled with a bundling material (e.g. plastic film) that has been unwound and formed by the unwind and former systems. As the product grouping advances through the former system 306 via former conveyor belts 372 (e.g. top conveyor belt(s), bottom conveyor belt(s), side conveyor belt(s)), the bundling material is sealed at the top by a sealing method known in the art. The folding device 396 (e.g. clamp plates, folding jaw) and knife 398 act simultaneously or independently to fold, or tuck, the bundle material ends at the end of the product grouping at the same time the bundle material is cut by the knife 398. The vacuum tube 380 (made, for example, from spring steel) is attached to the former system 306 to suck air out of the bundle while being welded. According to a preferred embodiment, the vacuum tube 380 comprises a fish tail design, as shown in FIG. 18B.

According to one exemplary embodiment, the knife and exit conveyor system 308 is slidably retractable from the unwind system 305 and former system 306. This is intended to allow, for example, easy maintenance of both the unwind system 305, the former system 306 and the knife and conveyor system 308. Additionally, this allows for "running" bundling of products and cutting bundle material. Having the knife and exit conveyor system 308 move with the product(s) and bundle material allows for extra time during sealing, extra time for air extraction from the bundle and continuous movement of product flow. This provides for less bad seals and faster bundling of products.

Finished bundled product groupings exit the bundler module 300 by the exit conveyor 399, as shown in FIGS. 18A and 18B. According to an alternative embodiment, a bundle may exit the modular packaging system 10 in either a straight or right- or left-hand direction. According to another alternative embodiment, the exit conveyor 399 comprises a first exit conveyor (bottom) and a second exit conveyor (top) located directly vertical of the first exit conveyor. A top and bottom conveyor configuration allows for a product grouping to be pulled out of the knife 398, and then back in, to create a space for tucking and cutting the bundle material. This provides less stress on the bundling material resulting in fewer bad seals.

Materials and Construction

According to various exemplary embodiments, the assemblies and components of the modular packaging system 10 may be constructed from a variety of suitable materials, including metals, metal alloys, aluminum, polymers, composites, plastics (including polycarbonates, acrylics, high impact plastics and injection molded plastic), ceramics, rubbers, fabrics, ropes, etc. According to various exemplary embodiments, any suitable material may be used for the components of the modular packaging system 10. For example, the base may be constructed from steel, aluminum and the like.

The frame members may be constructed from metal, metal alloys, aluminum, plastics, polymers, composites, plastics, rubbers, etc. According to other alternative embodiments, any other suitable material may be used to construct the frame members. According to an exemplary embodiment, the frame members may be painted to improve aesthetic appeal.

Basic Operation

According to the exemplary embodiments shown in FIGS. 1-18B, many different types of objects and products may be packaged with the modular packaging system 10. For example, toilet paper rolls, paper towel rolls, tissue paper, napkins and single and multiple fold towels may be packaged with the system.

The modular packaging system 10 may be assembled according to standard practices and as described herein to provide a structure as shown in FIGS. 1-18B.

According to any preferred embodiment, a modular packing system 10 has a base system 100 that contains the lane diverter 120, along with much of the electrical system 170, control system 180 and drive devices 176 for the entire packaging system. Also provided are interchangeable packaging modules 50 for each of the packaging methods (case-packing, bundling, bagging and wrapping). The modular packing system 10 provides considerable overall cost savings because (among others) there is no need for the redundant equipment and costly electrical components. An additional feature is the reduced floor space required along with considerably less equipment to maintain and operate. This type of modular system allows for increased flexibility as new packaging methods become industry standards.

It is important to note that the construction and arrangement of the elements of the modular packaging system 10 as shown in the exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the types of interfaces (e.g., signs, letterings, pictures, etc.) may be varied, the length or width of the structures and/or members or other elements of the system may be varied, the nature or number of adjustment positions provided between the elements may be varied (e.g., by variations in the number of engagements, size of the engagement areas, or type of engagements). It should be noted that the elements and/or assemblies of the system may be constructed from any of a wide variety of materials that provide sufficient strength or durability, in any of a wide variety of colors, textures and combinations. Accordingly, all such modifications are intended to be included within the scope of the present inventions. Other substitutions, modifications, changes and omissions may be made in the design, operating conditions and arrangement of the exemplary embodiments without departing from the spirit of the present invention.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

What is claimed is:

1. A modular packaging system for packaging a product, comprising:

a base system configured to manipulate a product and configured to receive at least one of a group of packaging modules, wherein the base system is used with a variety of packaging modules depending on a desired packaged output; and a first packaging module selectively coupled to the base system, the first packaging module configured to further manipulate and package the product:

wherein the first packaging module is a bundler module having an upender system for upending an object coupled to the first packaging module, the upender system configured to manipulate an object from a horizontal orientation to a vertical orientation, the upender system comprising:

a cam plate having a cam groove;

a cam following device having a first end inserted in the cam groove;

a shaft having a first end coupled to a second end of the cam following device; and a lifting device coupled to the shaft.

2. The modular packaging system of claim 1 further comprising a transport device coupled to the first packaging module, the transport device configured to move the first packaging module.

3. The modular packaging system of claim 2 wherein the transport device is self propelled.

4. The modular packaging system of claim 1 further comprising a cutting and sealing element slidably coupled to the first packaging module adjacent the upender system.

5. The modular packaging system of claim 1 further comprising multiple belts attached to the first packaging module, the multiple belts configured to move a product through the first packaging module.

6. The modular packaging system of claim 5 wherein the multiple belts are located inside a former.

7. The modular packaging system of claim 1 wherein the lifting device is a plurality of fingers.

8. The modular packaging system of claim 1 further comprising multiple lifting devices coupled to multiple shafts.

9. The modular packaging system of claim 1 wherein the lifting device remains in a vertical orientation after manipulating the object from the horizontal orientation to the vertical orientation.

10. The modular packaging system of claim 9 wherein the lifting device pushes the object forward in the vertical orientation after manipulating the object from a horizontal orientation to the vertical orientation.

* * * * *